US008845344B2

(12) United States Patent
Ishiyama

(10) Patent No.: US 8,845,344 B2
(45) Date of Patent: Sep. 30, 2014

(54) LOCK-RELEASE ADAPTER AND COMMUNICATION CABLE UNIT

(75) Inventor: Kazunori Ishiyama, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 111 days.

(21) Appl. No.: 13/554,326

(22) Filed: Jul. 20, 2012

(65) Prior Publication Data

US 2013/0045614 A1 Feb. 21, 2013

(30) Foreign Application Priority Data

Aug. 18, 2011 (JP) ..... 2011-178961

(51) Int. Cl.
*H01R 13/44* (2006.01)
*H01R 13/633* (2006.01)
*H01R 43/26* (2006.01)

(52) U.S. Cl.
CPC ..... *H01R 13/633* (2013.01); *H01R 43/26* (2013.01)
USPC ..... 439/133; 439/304

(58) Field of Classification Search
CPC ..... H01R 13/6397; H01R 13/6272; H01R 13/6275; H01R 13/447; H01R 23/025
USPC ..... 439/133, 136, 304, 309, 352, 354, 357, 439/676
See application file for complete search history.

(56) References Cited

U.S. PATENT DOCUMENTS

| | | | | |
|---|---|---|---|---|
| 5,564,939 | A | 10/1996 | Maitani et al. | |
| 7,806,706 | B2 * | 10/2010 | Obenshain | 439/133 |
| 7,909,625 | B2 * | 3/2011 | Obenshain | 439/133 |
| 8,545,243 | B2 * | 10/2013 | Lin | 439/133 |
| 8,632,352 | B2 * | 1/2014 | Wagner | 439/352 |
| 2009/0007609 | A1 | 1/2009 | Obenshain | |
| 2009/0318005 | A1 | 12/2009 | Saitoh | |

FOREIGN PATENT DOCUMENTS

| | | |
|---|---|---|
| JP | 3078147 | 6/2000 |
| JP | 2006-71888 | 3/2006 |
| JP | 2010-3601 | 1/2010 |
| JP | 2010-161027 | 7/2010 |
| JP | 2010-532552 | 10/2010 |

* cited by examiner

*Primary Examiner* — Thanh Tam Le
(74) *Attorney, Agent, or Firm* — Staas & Halsey LLP

(57) ABSTRACT

A lock-release adapter attached to a first connector, the first connector being put into a locked state with a second connector upon the first connector being fitted with the second connector, the locked state being released when a lock-release projection of the first connector is depressed, the lock-release adapter includes a holder fitted with the first connector, and an axial member pivotally supported by the holder, the axial member including, at one end in a direction of the pivot axis of the axial member, a projection portion that projects in a direction perpendicular to the pivot axis, the projection portion depressing the lock-release projection to release the locked state when the axial member is in a first pivot position.

9 Claims, 27 Drawing Sheets

10
12
11
14
10a
XXIE
15
10b
XXID 10
12
116
10a
11
12
10b 10
11
10a
12
10b

180−β
10
111
113
117
12
11
12
14
15
14
10b 10
13
12
14
116
111
11
15
12
14
10a
13

LOCK-RELEASE ADAPTER AND COMMUNICATION CABLE UNIT

CROSS-REFERENCE TO RELATED APPLICATION

This application is based upon and claims the benefit of priority of the prior Japanese Patent Application No. 2011-178961, filed on Aug. 18, 2011, the entire contents of which are incorporated herein by reference.

FIELD

The embodiments discussed herein are related to a lock-release adapter for a cable connector and a communication cable unit.

BACKGROUND

FIG. 27 is a perspective view of an information processing apparatus 500 and FIG. 28 is a perspective view of a communication cable unit 50. The information processing apparatus 500 is, for example, an FC (fibre channel) switch and has two input/output ports 501 in the example illustrated in FIG. 27. In the example illustrated in FIG. 27, each of the input/output ports 501 has 12 female connectors 52.

The communication cable unit 50 for connection with another apparatus is attached to each female connector 52.

As illustrated in FIG. 28, the communication cable unit 50 has a male connector 54 at end portions of communication cables 53. A description below will be given of an example in which the communication cables 53 are FC cables.

Through insertion of the male connector 54 into the female connectors 52 of the input/output port 501, the communication cable unit 50 is attached to the information processing apparatus 500.

In the communication cable unit 50 illustrated in FIG. 28, the male connector 54 is formed to serve as a DLC (Duplex LC) connector that couples two FC cables 53 in parallel. Since the shape and so on of the DLC connector are defined by, for example, a standard such as IEC 61754-20, a detailed description thereof is not given herein.

The male connector 54 has a housing 541. First ends of the paired FC cables 53 are attached to one end of the housing 541 in parallel to each other. Terminals 543 that are electrically continuous with core portions (not illustrated) of the FC cables 53 protrude from another end of the housing 541.

Two lock projections 544, which are elastic plate members, are attached to upper portions of the terminals 543 in the housing 541 in parallel to each other along the terminals 543.

The lock projections 544 are disposed with the first end portions thereof being secured to the housing 541 in a cantilever manner so as to form oblique surfaces. With this arrangement, the lock projections 544 are elastically deformed to allow up-and-down movement of second end portions 544*a* thereof.

FIG. 29 is a perspective view illustrating a state in which the male connector 54 for the FC cables 53 is attached to the female connector 52.

The male connector 54 is inserted into a fitting hole in the female connector 52 for attachment, so that the terminals 543 are connected to terminals (not illustrated) so as to allow electrical continuity.

For insertion of the male connector 54 into the fitting hole in the female connector 52, the lock projections 544 are inserted into the fitting hole while being elastically deformed in such a manner that they are depressed by an edge portion and so on of the fitting hole and are pressed against the housing 541. The biasing that the edge portion and so apply to the lock projections 544 in the fitting hole is released at a position where the terminals 543 of the male connector 54 may be electrically continuous with the terminals in the female connector 52. Thus, the lock projections 544 move in a direction away from the housing 541, so that portions of the lock projections 544 engage in engagement holes 522 formed in the female connector 52.

As described above, since the lock projections 544 engage in the engagement holes 522 when the male connector 54 is inserted into the female connector 52, falling of the male connector 54 out of the female connector 52 is suppressed. That is, the male connector 54 is locked into the female connector 52 (this state is hereinafter referred to as a "locked state").

For removal of the male connector 54 from the female connector 52, the end portions 544*a* of the lock projections 544 are depressed to cause elastic deformation of the lock projections 544. That is, the engaged lock projections 544 are removed from the engagement hole 522 in the female connector 52 to release the locked state. In the state in which the locked state is released (i.e., an unlocked state), the male connector 54 is pulled out of the fitting hole in the female connector 52.

That is, the male connector 54 and the female connector 52, together with the lock projections 544 and the engagement hole 522, realize a push-pull locking mechanism.

In the examples illustrated in FIGS. 28 and 29, a lock-release aid plate 545 is formed at upper portions of the end portions 544*a* of the lock projections 544 so as to cover the end portions 544*a*. The lock-release aid plate 545 is an elastic plate member, and one end portion thereof is secured to the housing 541 in a cantilever manner. Thus, the lock-release aid plate 545 is configured so that elastic deformation of the lock-release aid plate 545 allows up-and-down movement of another end portion 545*a* of the lock-release aid plate 545. The end portion 545*a* of the lock-release aid plate 545 is positioned so as to overlap the upper portions of the end portions 544*a* of the lock projections 544.

With this arrangement, upon depression of the end portion 545*a* of the lock-release aid plate 545, the end portions 544*a* of the lock projections 544 are simultaneously depressed. That is, depressing the end portion 545*a* of the lock-release aid plate 545 may simultaneously put the lock projections 544 into the unlocked states.

Related art is disclosed in, for example, Japanese Laid-open Patent Publication No. 2006-071888.

However, since the sizes of connectors used for FC cables are small as described above, the female connectors 52 are often densely installed in a small area of the input/output port 501 in order to miniaturize an information processing apparatus. Consequently, the upper, lower, left, and right gaps between the male connectors 54 are very small in many cases.

FIG. 30 is an enlarged perspective view of the input/output ports 501 illustrated in FIG. 27. In the example illustrated in FIG. 30, the communication cable units 50 are attached to the female connectors 52, respectively.

As illustrated in FIG. 30, when three or more female connectors 52 are vertically arranged (or when female connectors 52 are vertically arranged at three or more stages) at the input/output port 501, the upper and lower gaps of the female connectors 52 located at the middle are significantly reduced. Thus, the female connector 52 located at the middle, in particularly, has a problem in that it is very difficult for an operator to perform work for releasing the lock by depressing the lock-release aid plate 545 with his or her finger in order to remove the communication cable unit 50.

Since the lock-release aid plate 545 of the communication cable unit 50 for the FC cables is typically small and is hard to be depressed, the lock-release aid plate 545 may have to be depressed with a relatively strong force in order to release the locked state. In such a communication cable unit 50, even if other connectors are not provided above and below the male connector 54 and thus are not densely packed, there are problems in that it is difficult to for an operator to perform the work for releasing the locked state by depressing the lock-release aid plate 545 with his or her finger and thus the workability is low.

SUMMARY

According to an aspect of the embodiment, a lock-release adapter attached to a first connector, the first connector being put into a locked state with a second connector upon the first connector being fitted with the second connector, the locked state being released when a lock-release projection of the first connector is depressed, the lock-release adapter includes a holder fitted with the first connector, and an axial member pivotally supported by the holder, the axial member including, at one end in a direction of the pivot axis of the axial member, a projection portion that projects in a direction perpendicular to the pivot axis, the projection portion depressing the lock-release projection to release the locked state when the axial member is in a first pivot position.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

Embodiments of a lock-release adapter 1 will be described below with reference to the accompanying drawings. The embodiments described below are merely exemplary and illustrative, and thus are not intended to exclude various modifications and technical applications that are not explicitly described herein. That is, various modifications and changes may be made to the embodiments without departing from the scope and spirit of the present disclosure.

(A) First Embodiment

Figure 1:
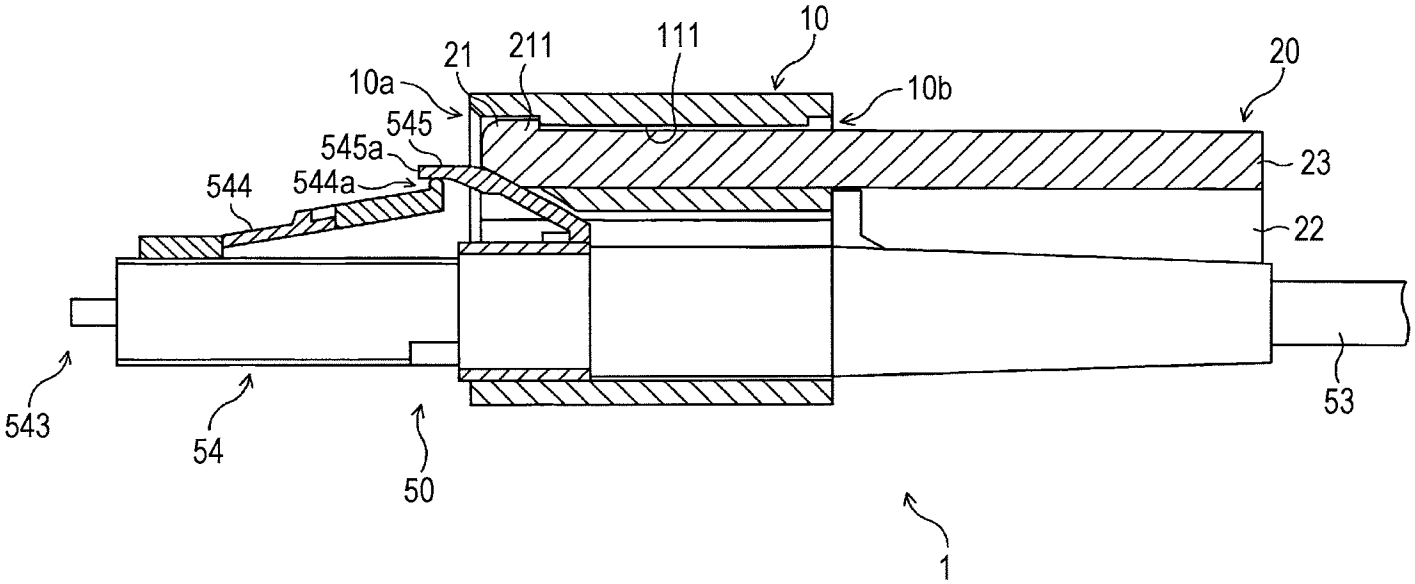
FIG. 1 is a sectional side view illustrating a locked state of a lock-release adapter that is one example of a first embodiment.
Figure 2:
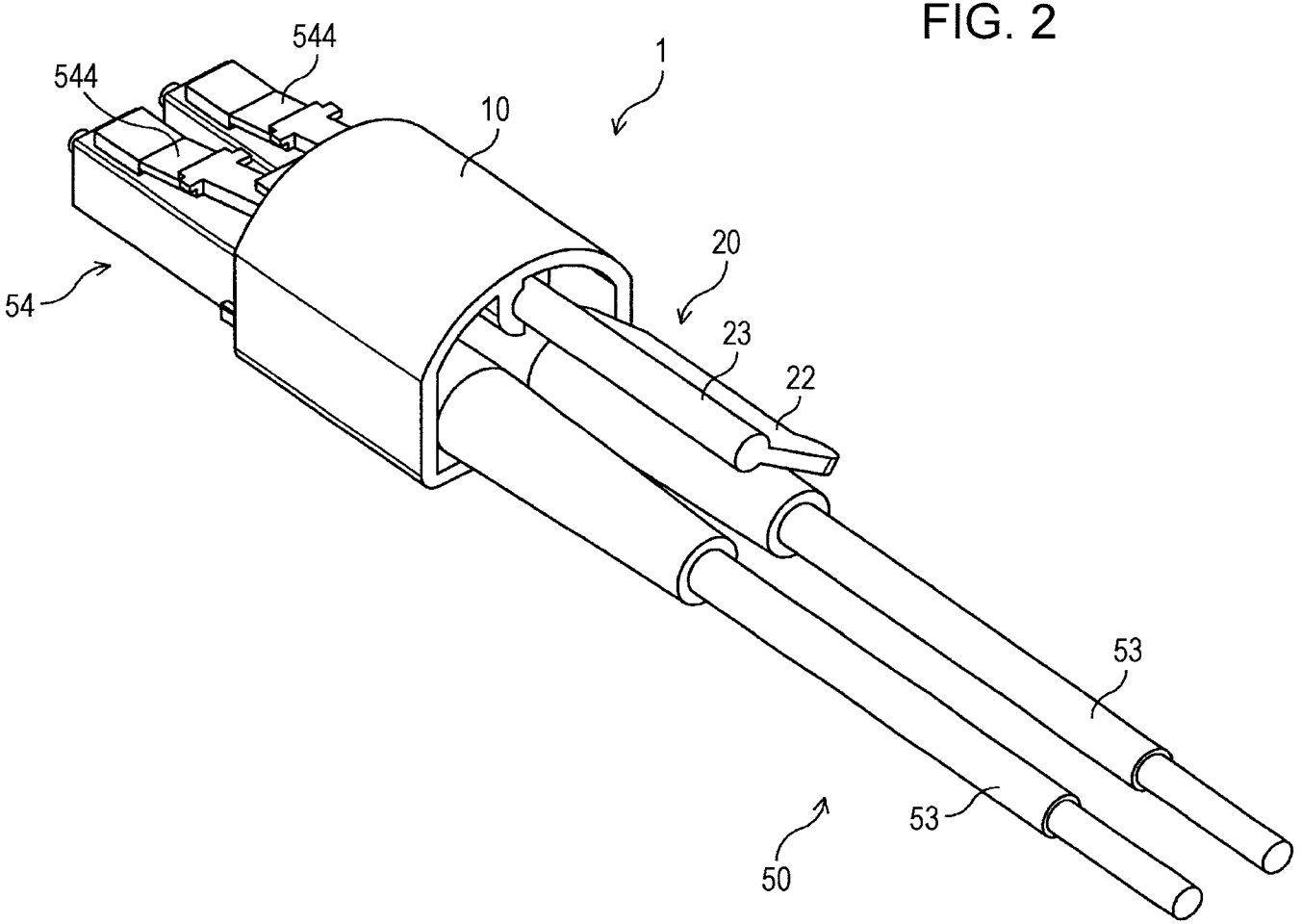
FIG. 2 is a perspective view illustrating the external appearance of the locked state of the lock-release adapter that is one example of the first embodiment.
Figure 3:
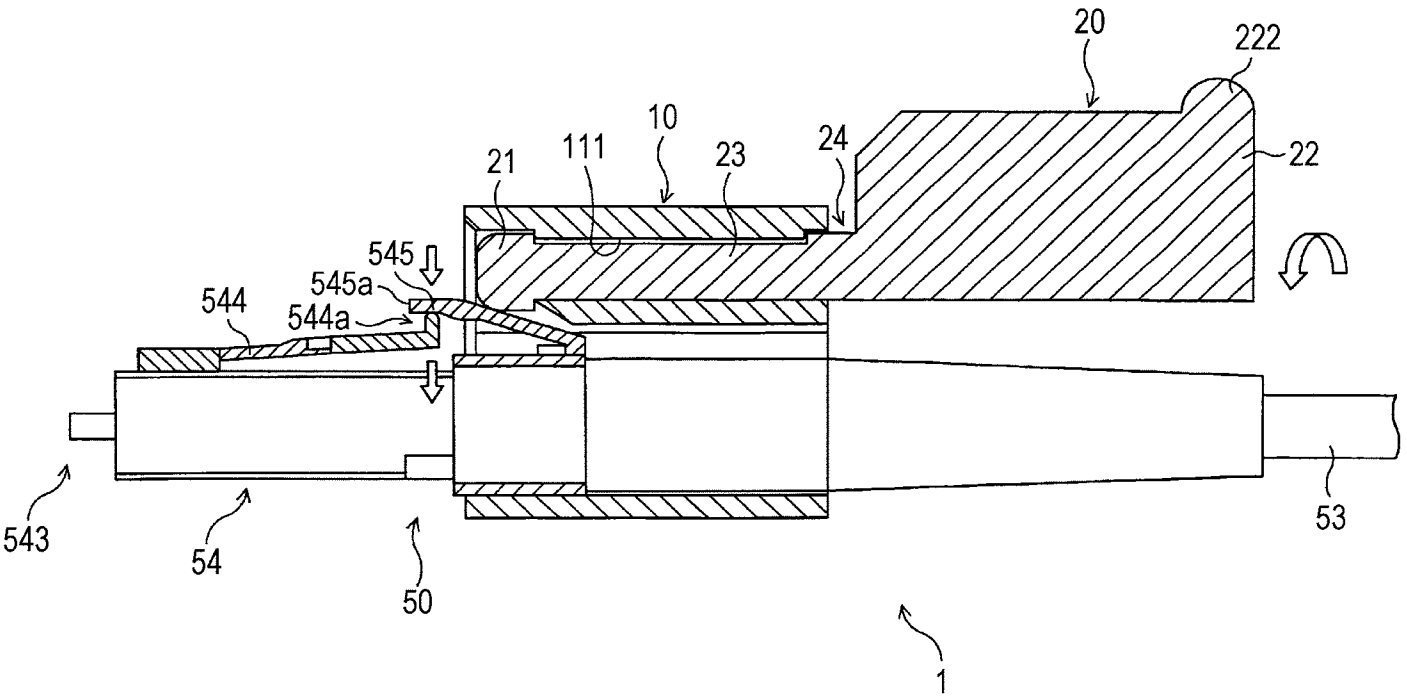
FIG. 3 is a sectional side view illustrating an unlocked state of the lock-release adapter that is one example of the first embodiment.
Figure 4:
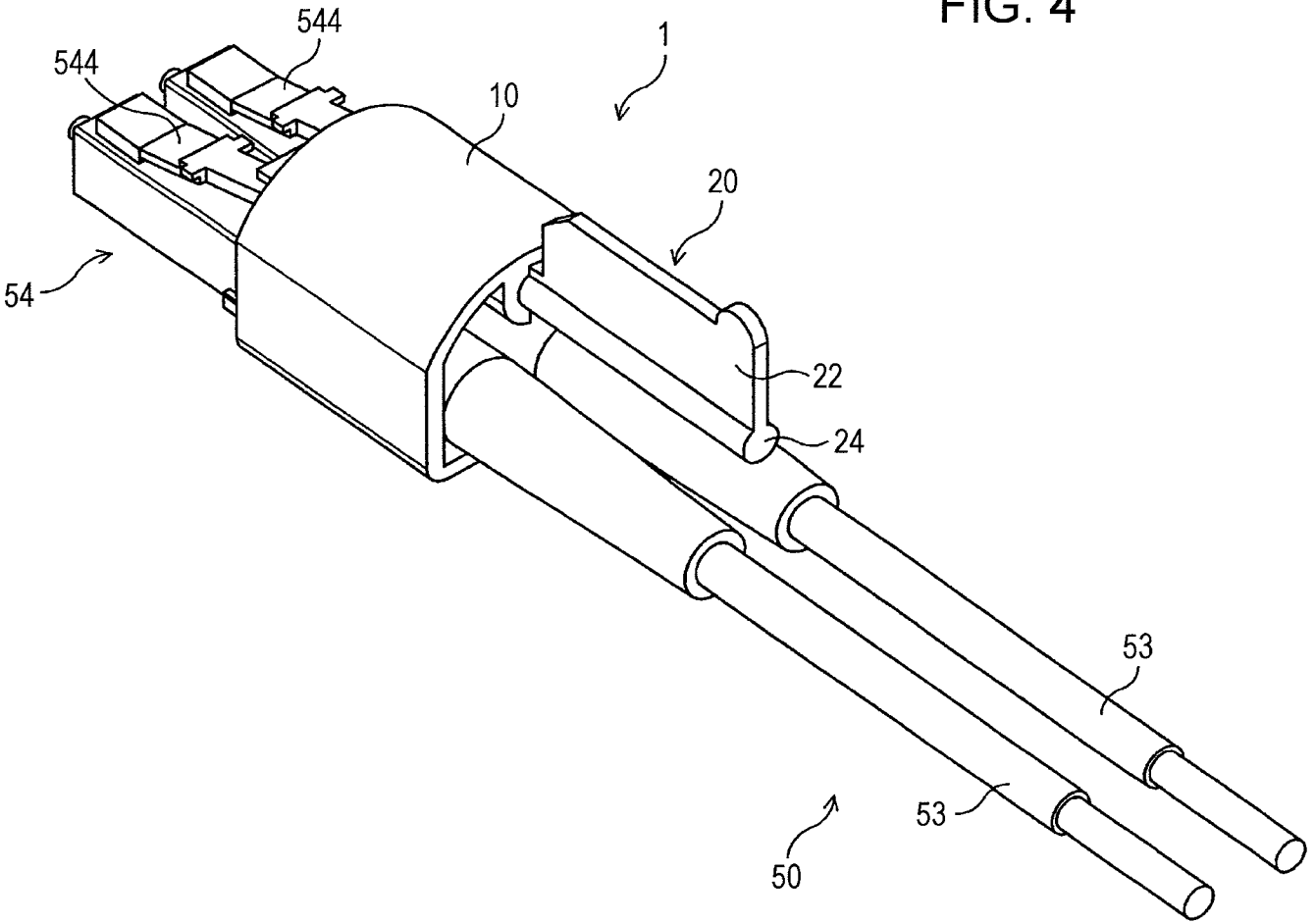
FIG. 4 is a perspective view illustrating the external appearance of the unlocked state of the lock-release adapter that is one example of the first embodiment.

FIG. 1 is a sectional side view illustrating a locked state of a lock-release adapter 1 that is one example of a first embodiment. FIG. 2 is a perspective view illustrating the external appearance of the lock-release adapter 1. FIG. 3 is a sectional side view illustrating an unlocked state of the lock-release adapter that is one example of the first embodiment. FIG. 4 is a perspective view illustrating the external appearance of the lock-release adapter.

Figure 28:
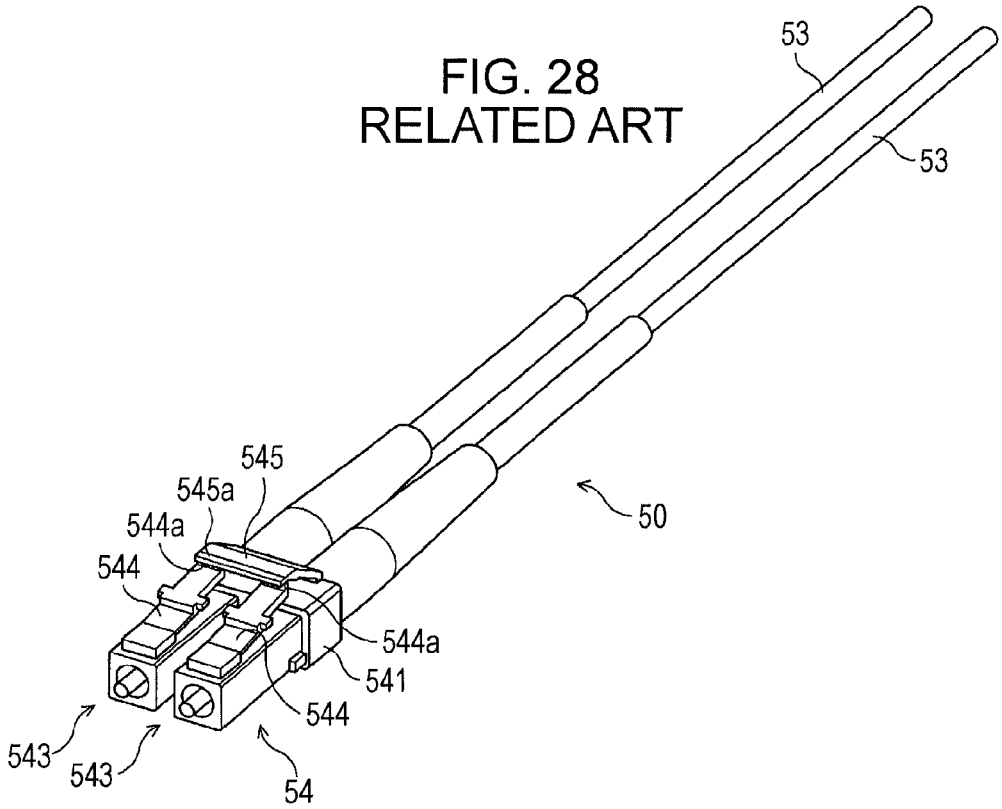
FIG. 28 RELATED ART
FIG. 28 is a perspective view of a communication cable unit.
Figure 29:
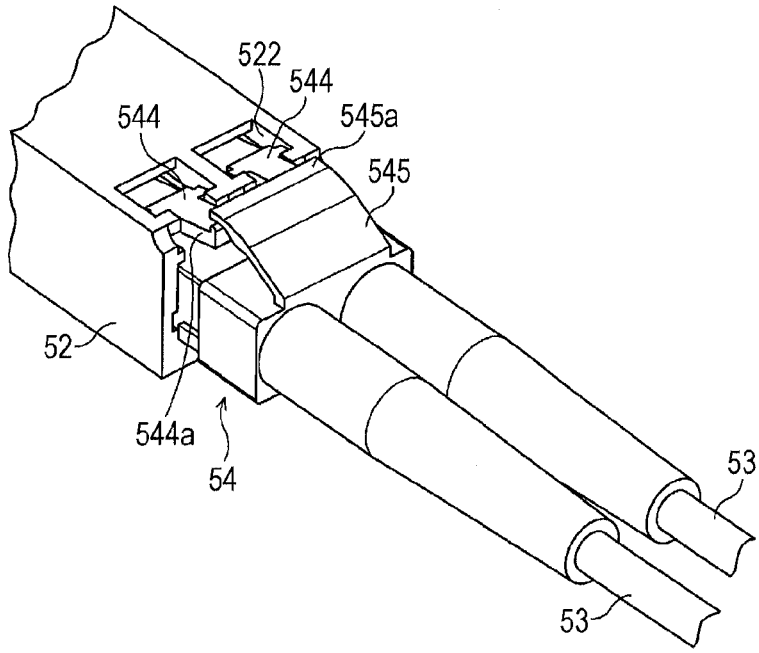
FIG. 29 RELATED ART
FIG. 29 is a perspective view illustrating a state in which a male connector for FC cables is attached to a female connector.
Figure 30:
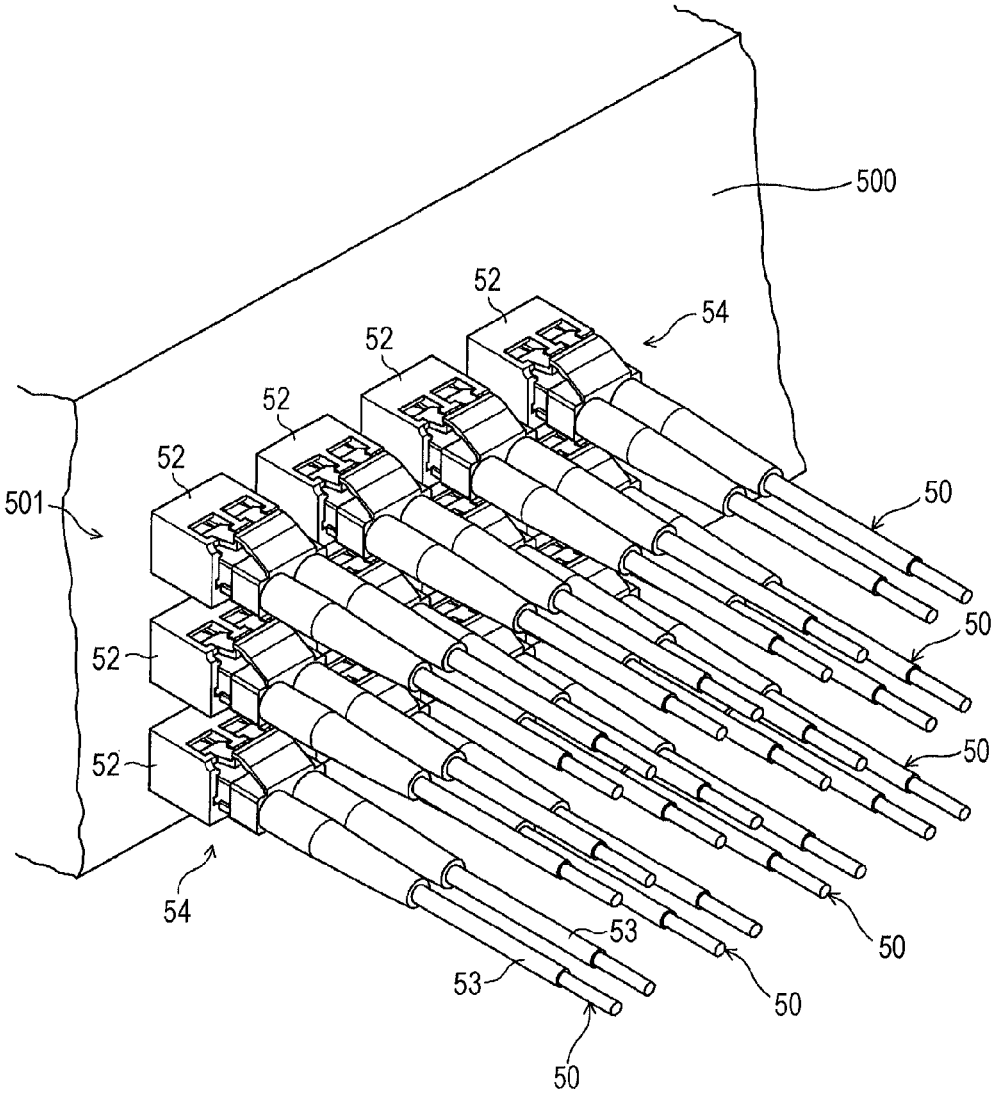
FIG. 30 RELATED ART
FIG. 30 is an enlarged perspective view of input/output ports illustrated in FIG. 27.

As illustrated in FIGS. 2 to 4 the lock-release adapter 1 that is one example of the first embodiment is attached to a male connector (a first connector) 54 of a communication cable unit 50 as illustrated in FIG. 28, and facilitates work for releasing the locked state of lock projections (lock-release projections) 544 and an engagement hole 522 of a female connector (a second connector) 52.

In the illustrated example, the lock-release adapter 1 is attached to a connector unit including the male connector 54 to which FC cables are connected and the female connector 52.

Hereinafter, the side at which the lock projections 544 of the male connector 54 are formed is referred to as an "upper side" and the side that is opposite to the upper side is referred to as a "lower side", for convenience of description. That is, for example, in the example illustrated in FIG. 1, the upper portion in FIG. 1 corresponds to the upper side. In FIGS. 1 and 3, the internal configurations of elements other than the lock projections 544 and the lock-release aid plate 545 of the male connector 54 and the internal configuration of the FC cables 53 are omitted for convenience of illustration.

As illustrated in FIG. 2, the lock-release adapter 1 has an adapter housing (a holder) 10 and a lock release lever (an axial member) 20.

The adapter housing 10 is secured to the male connector 54 of the communication cable unit 50 and pivotally supports the lock release lever 20.

Figure 5A:
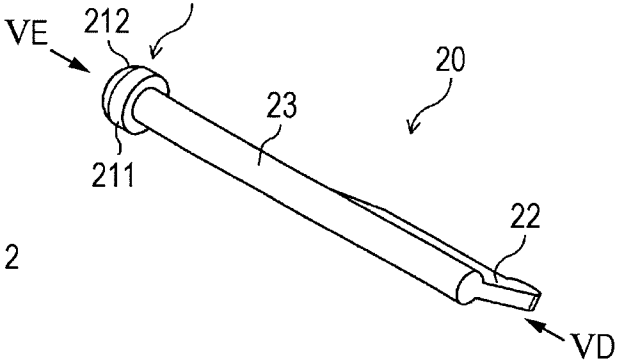
FIGS. 5A to 5E illustrate the configuration of a lock release lever of the lock-release adapter that is one example of the first embodiment.
Figure 5B:
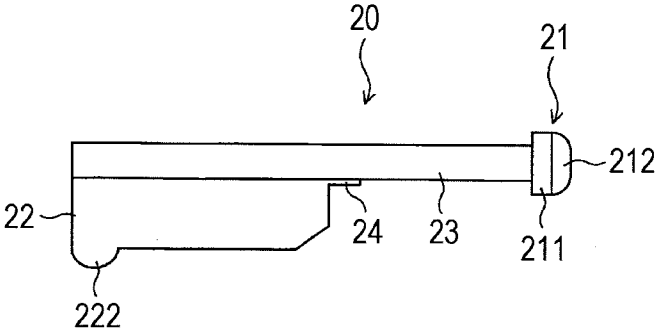
Figure 5C:
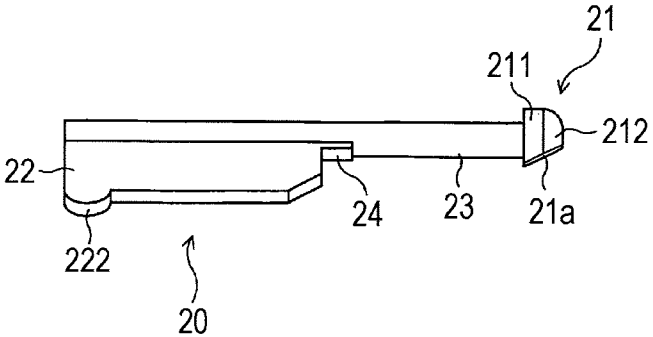
Figure 5D:
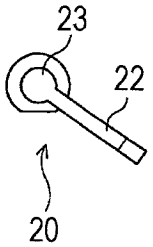
Figure 5E:
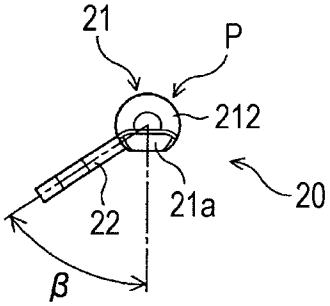
Figure 6:
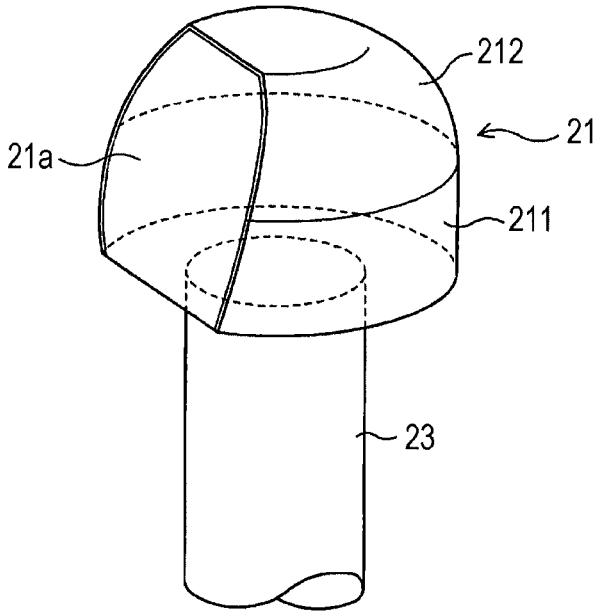
FIG. 6 is a perspective view illustrating the external appearance of a head of the lock-release adapter that is one example of the first embodiment.

FIGS. 5A to 5E illustrate the structure of the lock release lever 20 of the lock-release adapter 1 that is one example of the first embodiment. More specifically, FIG. 5A is a perspective view of the lock release lever 20, FIG. 5B is a top view thereof, FIG. 5C is a front view thereof, and FIGS. 5D and 5E are side views thereof. FIG. 5D is a view when viewed in the direction indicated by arrow VD in FIG. 5A and FIG. 5E is a view when viewed in the direction indicated by arrow VE in FIG. 5A. FIG. 6 is a perspective view illustrating a head 21 of the lock-release adapter 1 that is one example of the first embodiment.

As illustrated in FIG. 5A, the lock release lever 20 has the head (a depression projection portion) 21 at a first end of a cylindrical shaft 23 and has a knob 22 at a second end of the shaft 23.

As illustrated in FIG. 6, the head 21 has a larger diameter than the axial diameter of the shaft 23 and has a cylindrical portion 211 that protrudes in a direction perpendicular to the axis (the pivot axis) of the shaft 23. The cylindrical portion 211 is attached to the first end of the shaft 23 so that the center axis of the cylindrical portion 211 is aligned with the axis (the pivot axis) of the shaft 23. The cylindrical portion 211 is provided with a dome portion 212 at the opposite side of the shaft 23, with the center axis of the dome portion 212 being aligned with the center axis of the cylindrical portion 211. Thus, the head 21 has a substantially spherical shape.

As illustrated in FIGS. 5C and 6, the head 21 has an oblique surface 21*a*, which is formed by cutting off a portion of the dome portion 212 and the cylindrical portion 211. That is, the oblique surface 21*a* corresponds to a non-protrusion portion that lacks the head 21. It is desirable that the oblique surface 21*a* be a flat surface or a curved surface that is close to a large-curvature flat surface. As illustrated in FIG. 6, the interface between the oblique surface 21*a* and the cylindrical portion 211 and the dome portion 212 is chamfered, so that the oblique surface 21*a*, the cylindrical portion 211, and the dome portion 212 continue smoothly.

Figure 7:
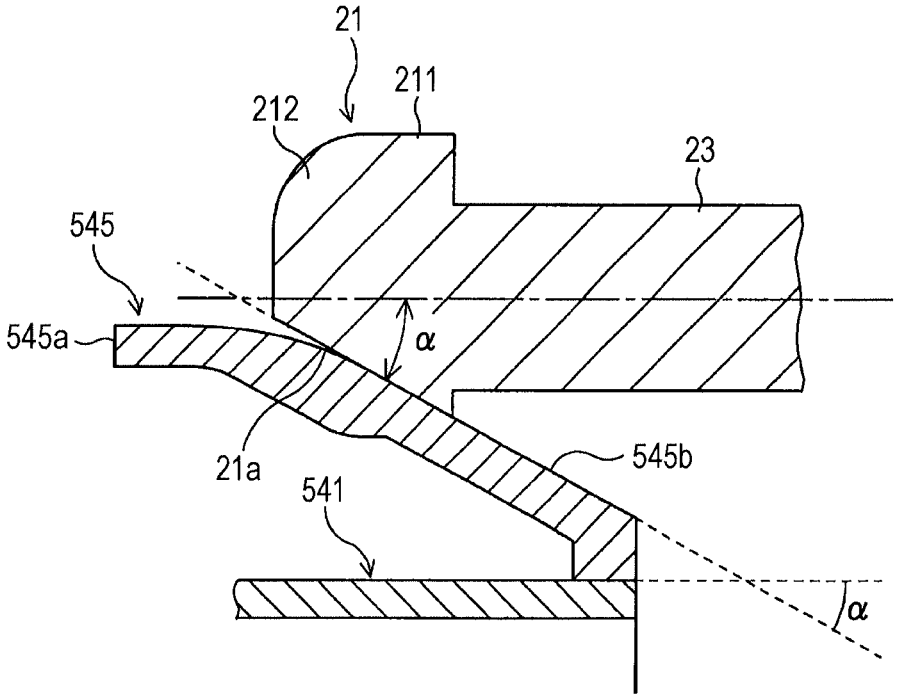
FIG. 7 is a sectional side view illustrating the shape of the head of the lock-release adapter that is one example of the first embodiment.

FIG. 7 is a sectional side view illustrating the shape of the head 21 of the lock-release adapter 1 that is one example of the first embodiment.

As illustrated in FIG. 1, the oblique surface 21*a* of the head 21 faces the lock-release aid plate 545 of the male connector 54. Thus, it is desired that the angle of the oblique surface 21*a* with respect to the axis of the shaft 23 be the same as or substantially the same as an angle $\alpha$ at which the lock-release aid plate 545 of the male connector 54 protrude from the surface of the housing 541, as illustrated in FIG. 7.

With this arrangement, when the lock-release adapter 1 is attached to the communication cable unit 50 and the oblique surface 21*a* of the head 21 is directed downward as illustrated in FIG. 1, the oblique surface 21*a* and the lock-release aid plate 545 face each other with a small gap therebetween or in contact with each other. Thus, the head 21 does not interfere with the lock projections 544 of the male connector 54, thus inhibiting the lock-state release due to depression of the lock projections 544 of the male connector 54.

That is, when the head 21 is pivoted to cause the oblique surface 21*a* thereof to face the lock-release aid plate 545, this state is a non-depressed state in which the head 21 does not depress the lock projections 544. This un-depressed state refers to not only a state in which the head 21 does not depress the lock projections 544 but also a state in which the engagement of the lock projections 544 and the engagement hole 522 of the female connector 52 is not completely released even when the lock projections 544 are slightly depressed. That is, the non-depressed state corresponds to a state in which the engagement of the lock projections 544 and the engagement hole 522 of the female connector 52 is not released (i.e., an engagement non-release state).

Since the head 21 is formed to have a substantially spherical shape having the cylindrical portion 211 and the dome portion 212, it is possible to reduce changes in the outer dimensions in the vicinity of the head 21 when the lock release lever 20 is pivoted. Thus, the size of the lock-release adapter 1 may be reduced.

A state in which the lock release lever 20 is pivoted so that the oblique surface 21*a* of the head 21 is directed downward, as illustrated in FIG. 1, may hereinafter be referred to as a "first posture".

The knob 22 is a plate member that protrudes, at the opposite side of the head 21 of the shaft 23, from the circumferential surface of the shaft 23 so as to extend along the axial direction of the shaft 23.

The knob 22 has an edge portion at the opposite side of the head 21 in the axial direction of the shaft 23. A projection portion 222 that protrudes in a semicircular shape is formed at the edge portion.

An operator performs a pivot operation of the lock release lever 20 while holding the knob 22 to switch between the state (the locked state) illustrated in FIGS. 1 and 2 and the state (unlocked state) illustrated in FIGS. 3 and 4.

The shaft 23 has a pivot-angle regulating projection 24 that protrudes at the head 21 side of the knob 22 so as to be adjacent to the knob 22. The pivot-angle regulating projection 24 engages in a pivot-angle regulating ditch 113 (see FIG. 8D) formed in the adapter housing 10.

When the lock release lever 20 is viewed in the direction indicated by arrow VE in FIG. 5A, the position at which the oblique surface 21*a* is formed and the position at which the knob 22 protrudes has a given positional relationship as illustrated in FIG. 5E. Specifically, it is desired that, when the head 21 is viewed in the axial direction of the shaft 23, the knob 22 protrude to a lower position than the horizontal plane when the surface at which the oblique surface 21*a* is formed is directed downward. That is, it is desired that, when the head 21 is viewed in the axial direction of the shaft 23, an angle β formed by the normal direction of the oblique surface 21*a* and the protrusion direction of the knob 22 be 90 degrees or less. In the example illustrated in FIG. 5E, the angle β is about 55 degrees.

With this arrangement, when the lock release lever 20 assumes the first posture, the knob 22 protrudes to a lower position than the horizontal plane, as illustrated in FIG. 5E. It is, however, desirable that, in the first posture, the knob 22 be brought closer to the FC cables 53 to which the lock-release adapter 1 is attached to a degree to which the lock-release adapter 1 does not interfere with the FC cables 53.

When the lock release lever 20 is viewed in the direction indicated by arrow VE in FIG. 5A, i.e., when the head 21 is viewed in the axial direction of the shaft 23, the cylindrical portion 211 and the dome portion 212 protrude at a position P that opposes the knob 22 protrusion direction across the center axis of the shaft 23, as illustrated in FIG. 5E. That is, the oblique surface 21*a* is not formed at the position P that opposes the knob 22 protrusion direction across the center axis of the shaft 23.

With this arrangement, when the knob 22 is directed upward as illustrated in FIG. 3, the cylindrical portion 211 or the dome portion 212 of the head 21, instead of the oblique surface 21*a*, faces and contacts the lock projections 544 of the male connector 54 and the cylindrical portion 211 depresses the lock projections 544. As a result, the locked state is released.

That is, when a pivot operation of the lock release lever 20 is performed with the knob 22, the oblique surface 21*a* and the cylindrical portion 211 (the dome portion 212) are switched to face the lock projections 544 of the male connector 54, so that the locked state and the unlocked state are switched.

The state in which the knob 22 is directed upward as illustrated in FIG. 3 may hereinafter be referred to as a "second posture".

Figure 8A:
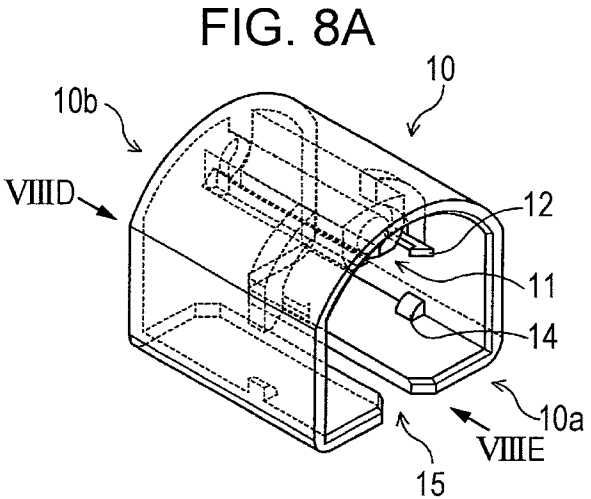
FIGS. 8A to 8E illustrate the configuration of an adapter housing of the lock-release adapter that is one example of the first embodiment.
Figure 8B:
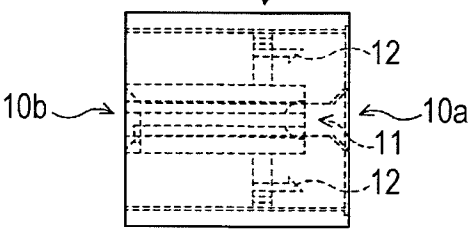
Figure 8C:
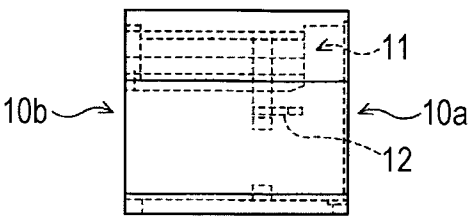
Figure 8E:
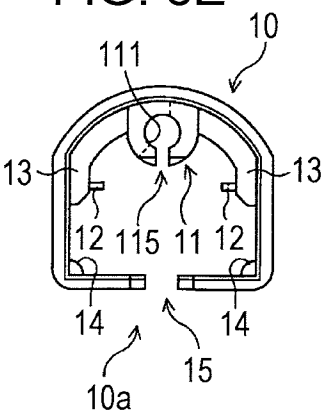
Figure 8D:
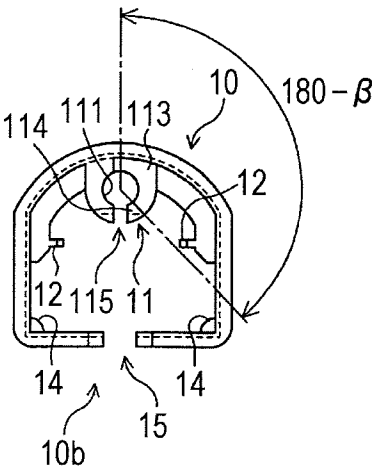
Figure 9:
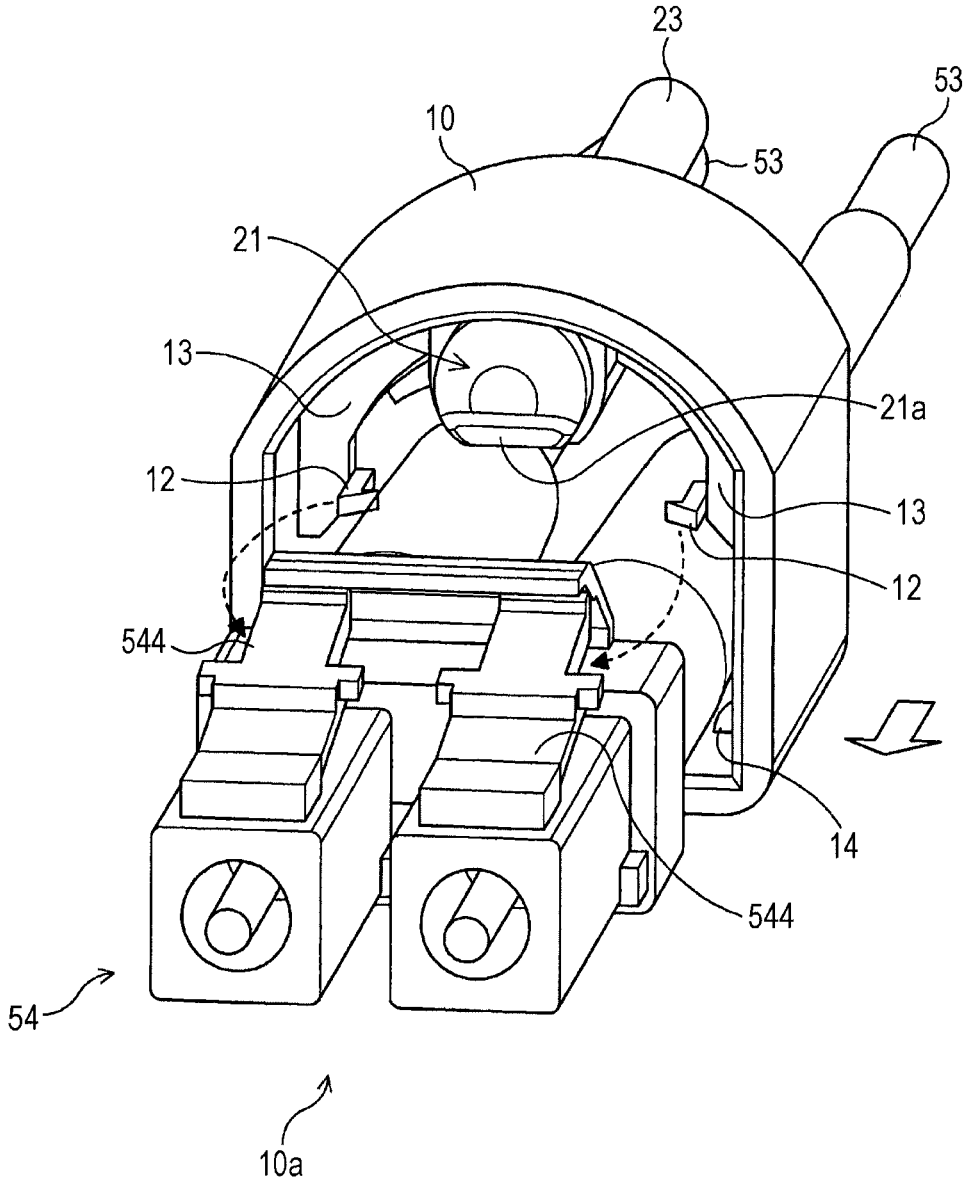
FIG. 9 is a perspective view illustrating a state in which the lock-release adapter that is one example of the first embodiment is attached to a communication cable unit.

FIGS. 8A to 8E illustrate the configuration of the adapter housing 10 of the lock-release adapter 1 that is one example of the first embodiment. More specifically, FIG. 8A is a perspective view of the adapter housing 10, FIG. 8B is a top view thereof, FIG. 8C is a front view thereof, and FIGS. 8D and 8E are side views thereof. FIG. 8D is a view when viewed in the direction indicated by arrow VIIID in FIG. 8A and FIG. 8E is a view when viewed in the direction indicated by arrow VIIIE in FIG. 8A. FIG. 9 is a perspective view illustrating a state in which the lock-release adapter 1 that is one example of the first embodiment is attached to the communication cable unit 50.

As illustrated in FIGS. 8A and 9, the adapter housing 10 has a tunnel shape having a pair of opposing openings 10*a* and 10*b*, and surrounds the communication cable unit 50 and the lock release lever 20 so that they penetrate the openings 10*a* and 10*b*.

As illustrated in FIGS. 8A to 8E, a guide 11 is formed at an upper portion of the inside of the adapter housing 10 between the openings 10*a* and 10*b*. The guide 11 is provided to guide the shaft 23 of the lock release lever 20 and has an arm-portion through hole 111 through which the shaft 23 is pivotally provided. That is, the adapter housing 10 pivotally supports the shaft 23 of the lock release lever 20.

At the lower side of the guide 11, an arm-portion attachment slit 115 is provided along the arm-portion through hole 111. For attachment of the lock release lever 20 to the guide 11 of the adapter housing 10, the knob 22 of the lock release lever 20 is passed through the arm-portion attachment slit 115, as described below. It is, therefore, desirable that the width of the arm-portion attachment slit 115 be larger than the plate thickness of the knob 22.

A pair of lock claws 12 is formed in the adapter housing 10 so as to extend toward the opening 10*a*. The lock claws 12 may be elastic members. As illustrated in FIG. 9, for attachment of the adapter housing 10 to the male connector 54 of the communication cable unit 50, for example, the lock claws 12 are hooked on the lock-release aid plate 545 of the male connector 54 to secure the adapter housing 10. That is, the lock claws 12 hold the lock-release aid plates 545 from two opposite sides in a hooking manner. Instead of hooking the lock-release aid plate 545, the locking method may be changed as appropriate. For example, the lock claws 12 may be hooked on other portions (e.g., recesses) in the housing 541 of the male connector 54.

As illustrated in FIGS. 8A, 8D, and 8E, a slit 15 is formed at a lower surface of the adapter housing 10 between the openings 10*a* and 10*b*. For attachment of the adapter housing 10 to the male connector 54 of the communication cable unit 50, the FC cables 53 are passed through the slit 15 to accommodate the communication cable unit 50 in the adapter housing 10. Thus, it is desired that the width of the slit 15 be larger than the thickness of the FC cables 53.

Connector-lock projections 13 and 14, which are projections for abutment of the end surface of the housing 541 of the male connector 54, are formed on inner wall surfaces of the adapter housing 10. The male connector 54 is positioned in the adapter housing 10 by the connector-lock projections 13 and 14 and is secured by the lock claws 12.

That is, the lock claws 12 and the connector-lock projections 13 and 14, formed so as to protrude in the adapter housing 10, secure the lock-release adapter 1 to the male connector 54.

The positions and the shapes of the lock claws 12 and the connector-lock projections 13 and 14 may be appropriately changed according to the shape of the male connector 54.

At the surface of the guide 11 at the opening 10*b* side, the pivot-angle regulating ditch 113 is partially formed along the opening of the arm-portion through hole 111, as illustrated in FIG. 8D. The pivot-angle regulating ditch 113 is formed by partially cutting off a portion around the opening of the arm-portion through hole 111 of the guide 11. In the example of the FIG. 8D, the pivot-angle regulating ditch 113 is formed by cutting off a portion with the same depth clockwise from the upper side of the opening of the arm-portion through hole 111 through an angle of about 180-β degrees. FIG. 8D illustrates an example in which the pivot-angle regulating ditch 113 is formed clockwise from the upper side of the opening of the arm-portion through hole 111 through an angle of about 135 degrees.

When the lock release lever 20 is attached to the adapter housing 10, the pivot-angle regulating projection 24 of the lock release lever 20 is inserted into the pivot-angle regulating ditch 113 and the pivot-angle regulating ditch 113 regulates movement of the pivot-angle regulating projection 24 that moves in conjunction with pivot of the lock release lever 20. That is, the pivot-angle regulating ditch 113 regulates the pivot angle of the lock release lever 20.

The area in which the pivot-angle regulating ditch 113 is formed in the guide 11 may be changed as appropriate.

At the surface of the guide 11 at the opening 10*b* side, the portion from the arm-portion attachment slit 115 to a lower end portion of the pivot-angle regulating ditch 113 has a taper 114 that continuously changes in the axial-direction dimension of the arm-portion through hole 111. That is, the axial-direction dimension of the arm-portion through hole 111 at the edge portion of the arm-portion attachment slit 115 of the guide 11 is smaller than the axial-direction dimension of the arm-portion through hole 111 at the lower end portion of the pivot-angle regulating ditch 113 and the axial-direction length of the arm-portion through hole 111 increases gradually toward the lower end portion of the pivot-angle regulating ditch 113.

For attachment of the lock release lever 20 to the adapter housing 10, the lock release lever 20 is inserted into the arm-portion through hole 111 of the guide 11 and then the lock release lever 20 is pivoted in the arm-portion through hole 111, so that the pivot-angle regulating projection 24 passed through the arm-portion attachment slit 115 is guided by the taper 114 and is inserted into the pivot-angle regulating ditch 113.

That is, the taper 114 is formed so as to facilitate that the pivot-angle regulating projection 24 of the lock release lever 20 is inserted into the pivot-angle regulating ditch 113.

The lock release lever 20 is attached to the adapter housing 10 configured as described above to thereby assemble the lock-release adapter 1.

Figure 10:
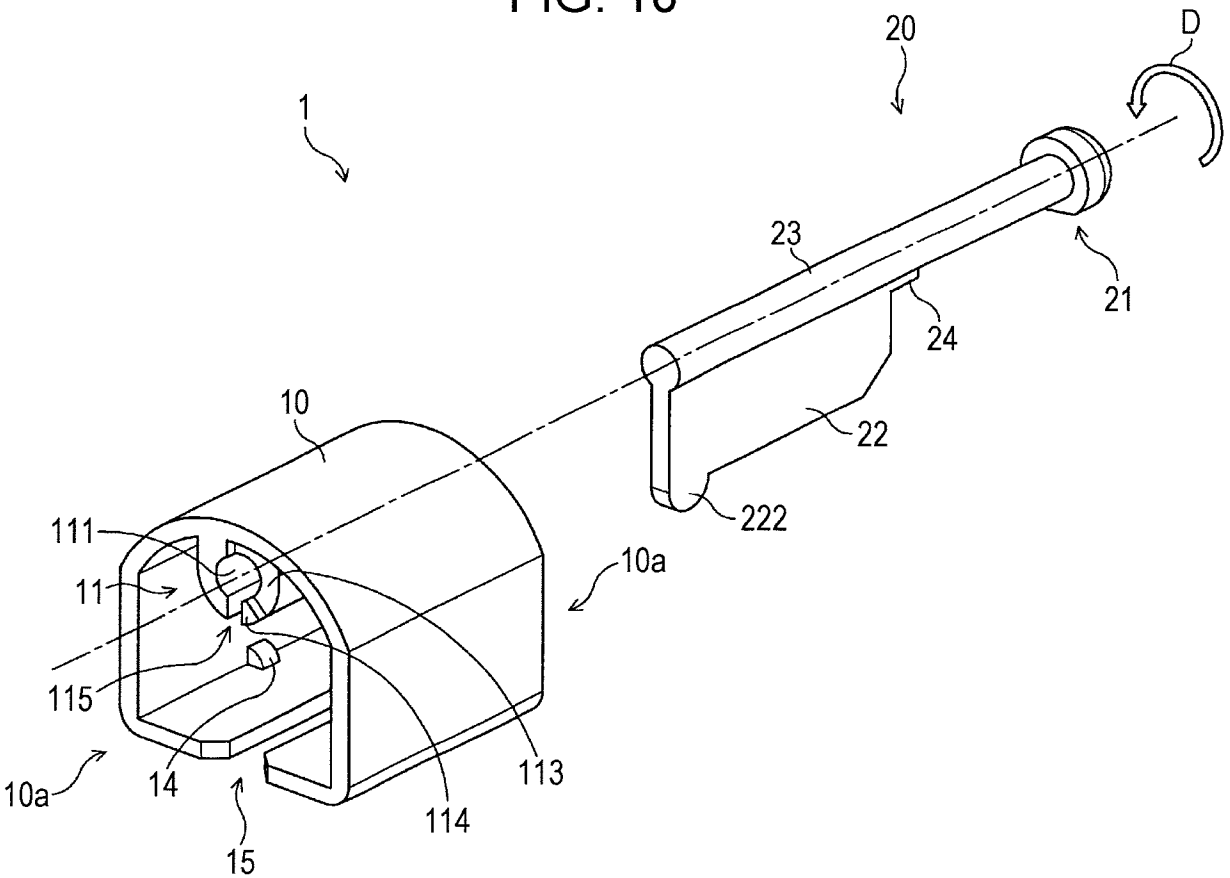
FIG. 10 is an exploded perspective view illustrating the configuration of the lock-release adapter that is one example of the first embodiment.

FIG. 10 is an exploded perspective view illustrating the configuration of the lock-release adapter 1 that is one example of the first embodiment. As illustrated in FIG. 10, the shaft 23 of the lock release lever 20 is inserted into the arm-portion through hole 111 of the guide 11 from the opening 10*a* of the adapter housing 10, to thereby attach that the lock release lever 20 to the adapter housing 10. In this case, the knob 22 is passed through the arm-portion attachment slit 115 of the guide 11.

Thereafter, when the lock release lever 20 is pivoted in the arm-portion through hole 111 in the direction indicated by arrow D in FIG. 10, the taper 114 of the guide 11 guides the pivot-angle regulating projection 24 into the pivot-angle regulating ditch 113. Even when the lock release lever 20 is pivoted in the arm-portion through hole 111, the pivot-angle regulating projection 24 once disposed in the pivot-angle regulating ditch 113 abuts the lower end portion of the pivot-angle regulating ditch 113 and thus does not easily fall out of the pivot-angle regulating ditch 113.

Figure 11B:
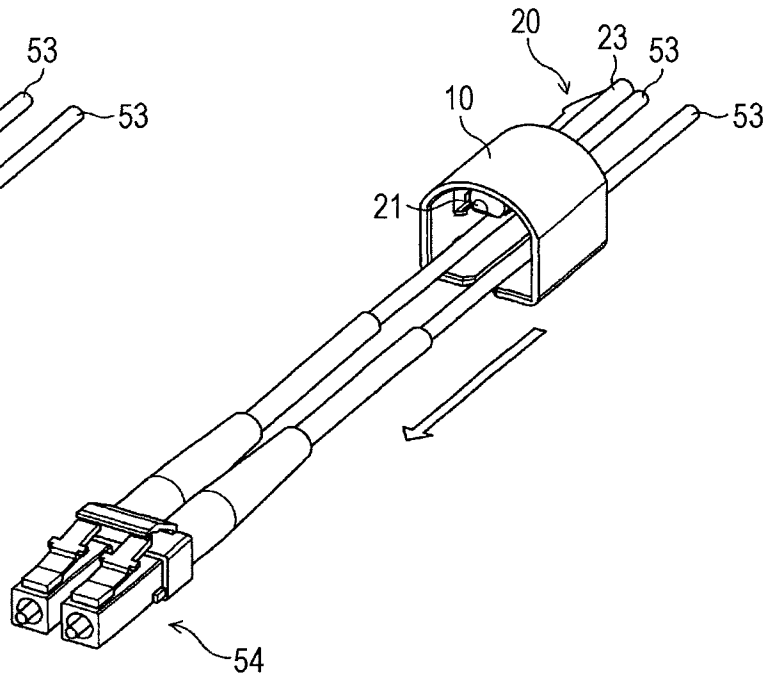
FIGS. 11A and 11B are perspective views illustrating a method for attaching the lock-release adapter that is one example of the first embodiment to the communication cable unit.
Figure 11A:
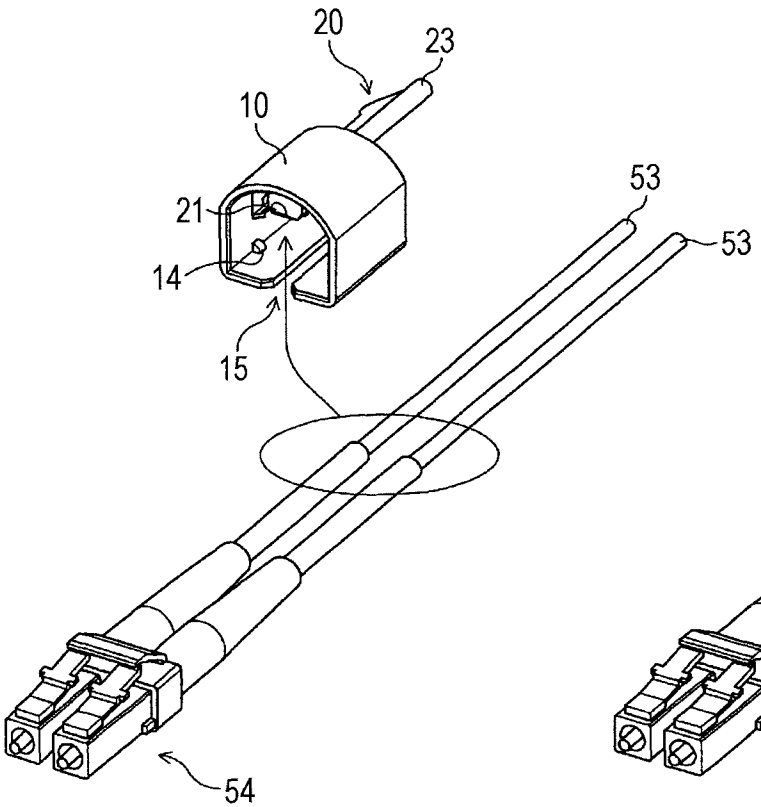

FIGS. 11A and 11B are perspective views illustrating a method for attaching the lock-release adapter 1 that is one example of the first embodiment to the communication cable unit 50. More specifically, FIG. 11A is a perspective view illustrating a state before the FC cables 53 are passed through the adapter housing 10 of the lock-release adapter 1 and FIG. 11B is a perspective view illustrating a state after the FC cables 53 are passed through the adapter housing 10.

As illustrated in FIG. 11A, the opening 10*a* of the adapter housing 10 is directed to the male connector 54 and the FC cables 53 are passed through the slit 15.

With the FC cables 53 being provided through the adapter housing 10, the adapter housing 10 is moved (slid) closer to the male connector 54 in the direction indicated by the arrow illustrated in FIG. 11B.

The lock-release adapter 1 is then secured to the male connector 54, as illustrated in FIG. 9. That is, with the male connector 54 abutting the connector-lock projections 13 and 14, the lock claws 12 are hooked on the lock-release aid plate 545 of the male connector 54 to thereby secure the lock-release adapter 1 to the male connector 54.

Figure 12:
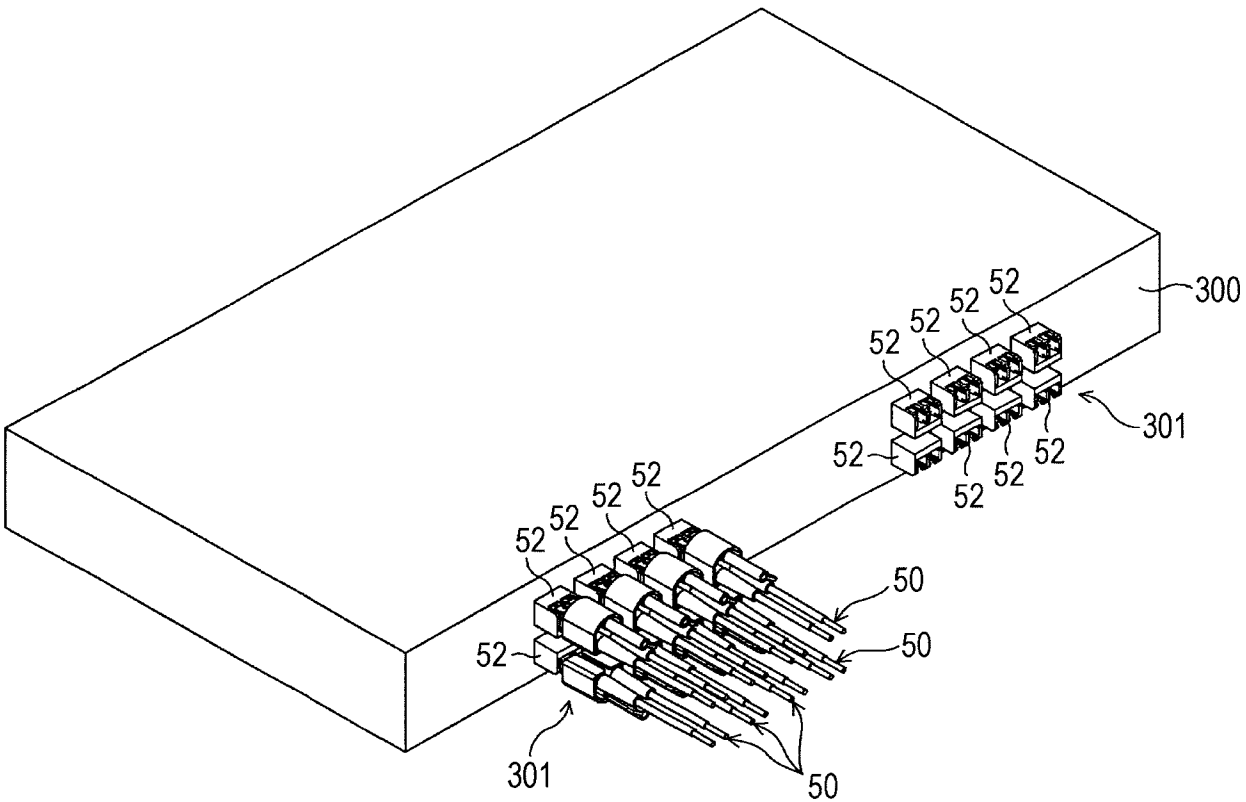
FIG. 12 is a perspective view of an FC switch serving as an information processing apparatus.
Figure 13:
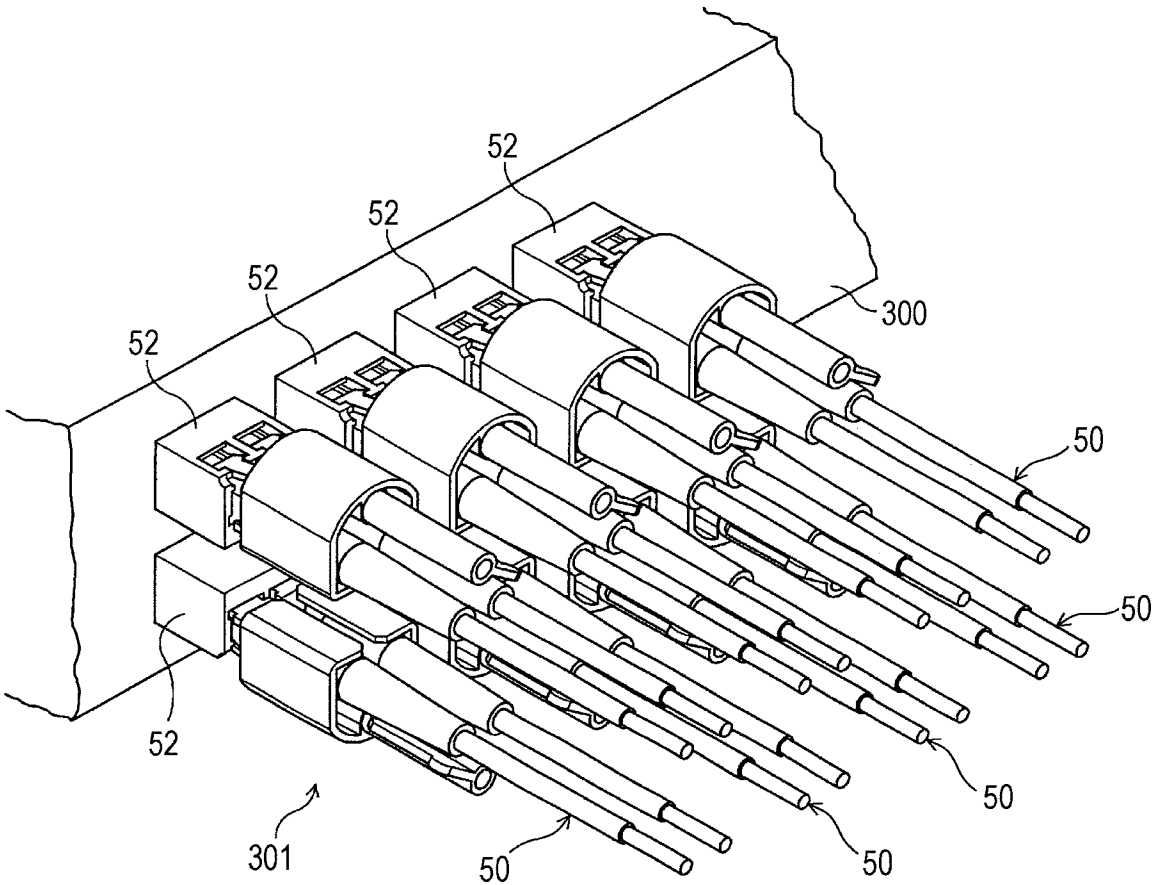
FIG. 13 is an enlarged view of an input/output port of the FC switch in FIG. 12.
Figure 14:
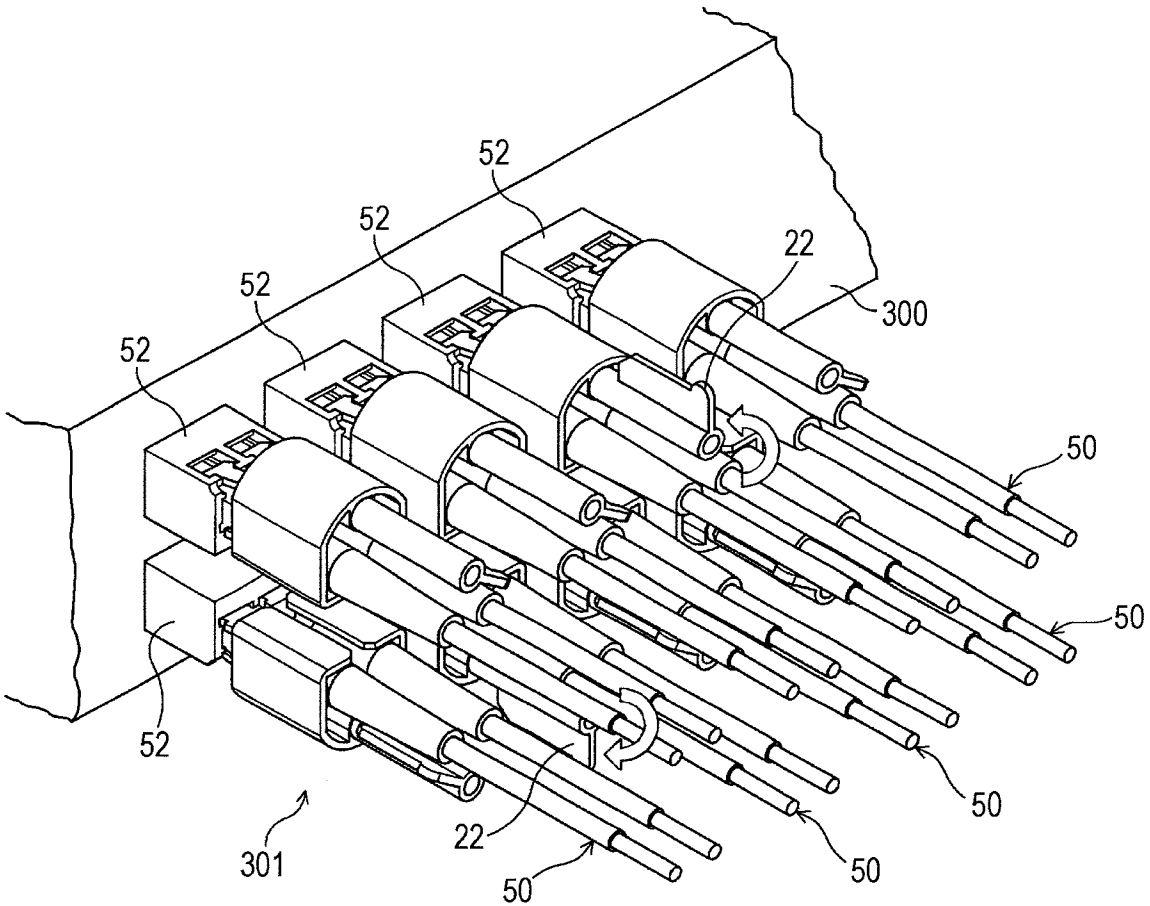
FIG. 14 is a perspective view illustrating an example in which some of the lock-release adapters at the input/output port illustrated in FIG. 13 are put into unlocked states.

FIG. 12 is a perspective view of an FC switch 300 serving as an information processing apparatus and FIG. 13 is an enlarged view of an input/output port 301 illustrated in FIG. 12. FIG. 14 is a perspective view illustrating an example in which some of the lock-release adapters 1 at the input/output port 301 illustrated in FIG. 13 are put into unlocked states.

In the example illustrated in FIG. 12, the FC switch 300 has two input/output ports 301. In the example illustrated in FIGS. 12 and 13, a total of eight female connectors 52 are arranged at each of two stages (i.e., upper and lower stages) at each input/output port 301.

In the example illustrated in FIGS. 12 and 13, of the female connectors 52 arranged at the two stages (the upper and lower stages) of the input/output port 301, the female connectors 52 arranged at the lower stage are attached with their orientations reversed by 180 degrees with respect to the female connectors 52 arranged at the upper stage.

The communication cable units 50 to which the lock-release adapters 1 are attached are attached to the female connectors 52. The communication cable unit 50 to which the lock-release adapter 1 is attached may hereinafter be referred to as an "adapter-equipped communication cable unit 50".

In the example illustrated in FIG. 12, the adapter-equipped communication cable units 50 are attached to the female connectors 52 of only one of the input/output ports 301.

When the adapter-equipped communication cable unit 50 is in the locked state in which the male connector 54 is attached to the female connector 52, the knob 22 of the lock-release adapter 1 is directed more downward than the horizontal plane, as in the adapter-equipped communication cable unit 50 attached to the female connector 52 at the upper stage illustrated in FIG. 13.

Since the lock-release adapter 1 is configured so that the knob 22 does not protrude to a higher position than the adapter housing 10 in the locked state, the locked-state releasing due to an unintentional operation of the knob 22 may be inhibited and the reliability may be improved.

For removal of the adapter-equipped communication cable unit 50, the knob 22 of the adapter-equipped communication cable unit 50 of interest (two adapter-equipped communication cable units are illustrated in the example of FIG. 14) are pivoted so as to be directed upward, as illustrated in FIG. 14. As a result, the head 21 is pivoted while the pivot-angle regulating projection 24 is guided into the pivot-angle regulating ditches 113.

As a result of the pivot of the head 21, the portion facing the lock-release aid plate 545 of the male connector 54 changes from the oblique surface 21*a* to the cylindrical portion 211 or the dome portion 212, so that the cylindrical portion 211 or the dome portion 212 depresses the lock-release aid plate 545 of the male connector 54. The lock-release aid plate 545 then depresses the lock projections 544 to release the locked state of the female connector 52 and the male connector 54.

With the adapter-equipped communication cable unit 50, the operator may easily release the locked state of the communication cable unit 50 by performing the pivot operation of the knob 22. By viewing the position of the knob 22, it is possible to easily perceive the locked state of the adapter-equipped communication cable unit 50. Thus, the convenience is high.

Figure 15:
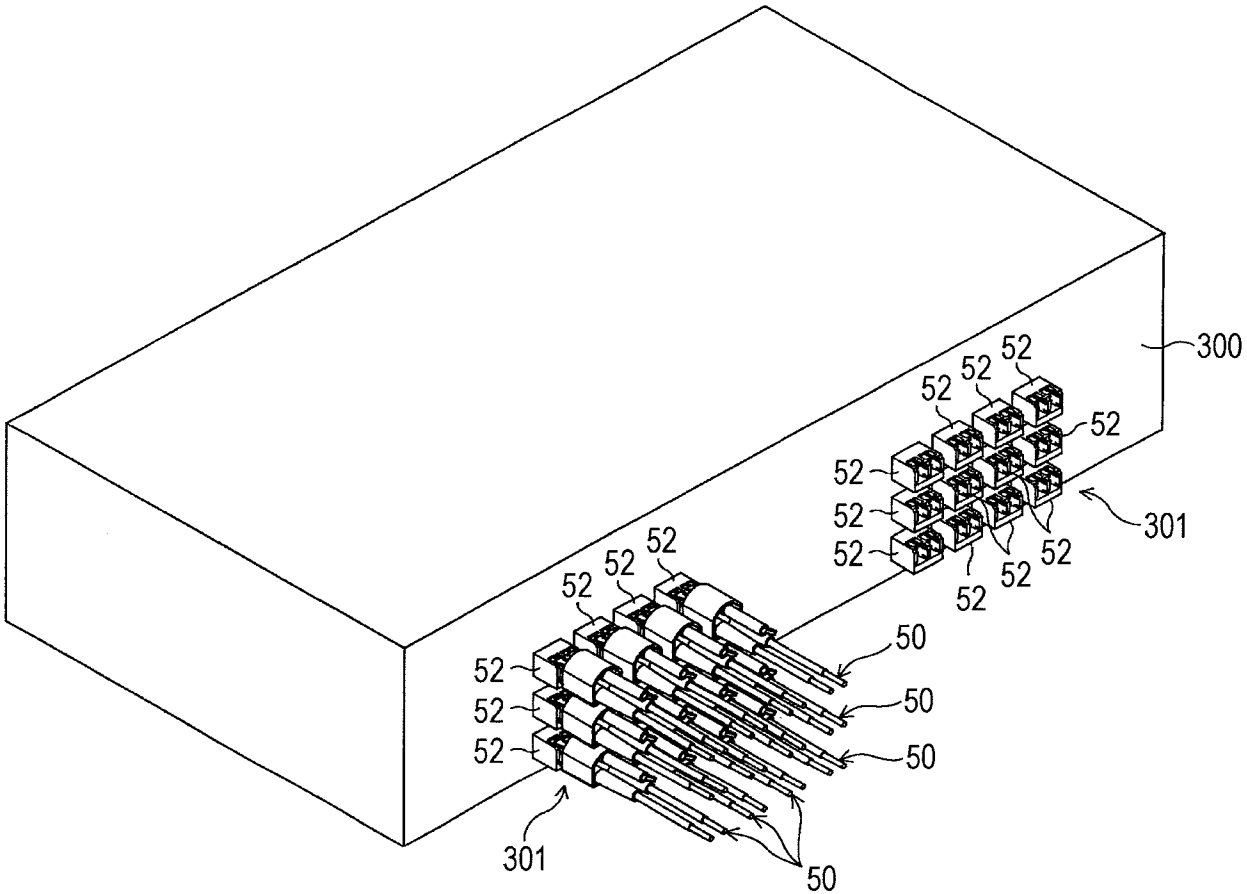
FIG. 15 is a perspective view of an FC switch serving as an information processing apparatus.
Figure 16B:
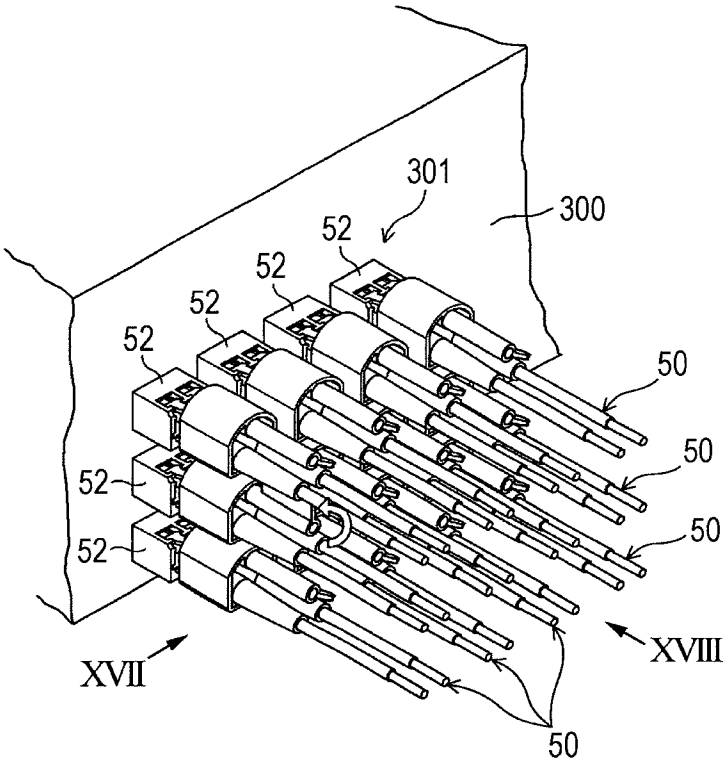
FIGS. 16A and 16B are enlarges views of an input/output port of the FC switch in FIG. 15.
Figure 16A:
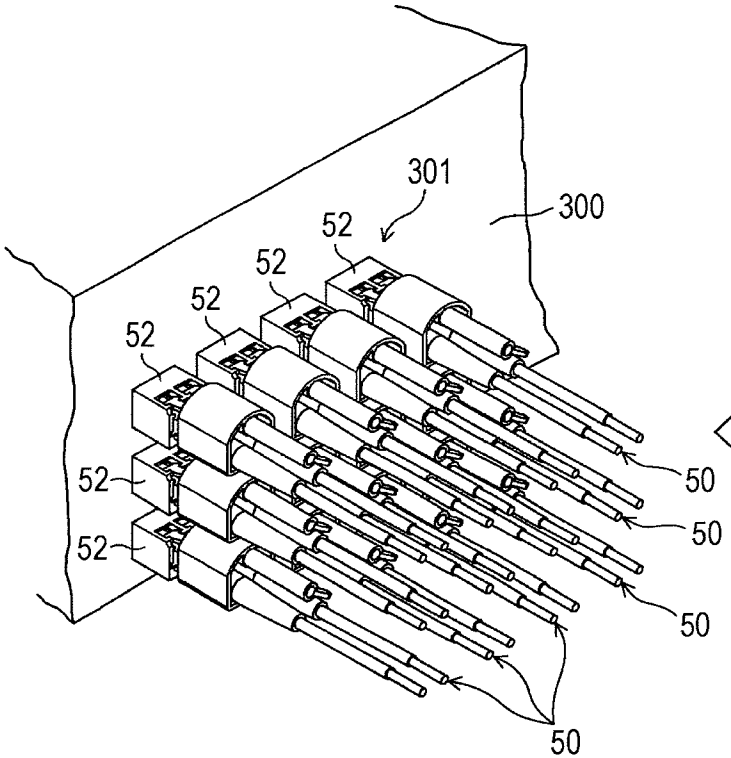
Figure 17:
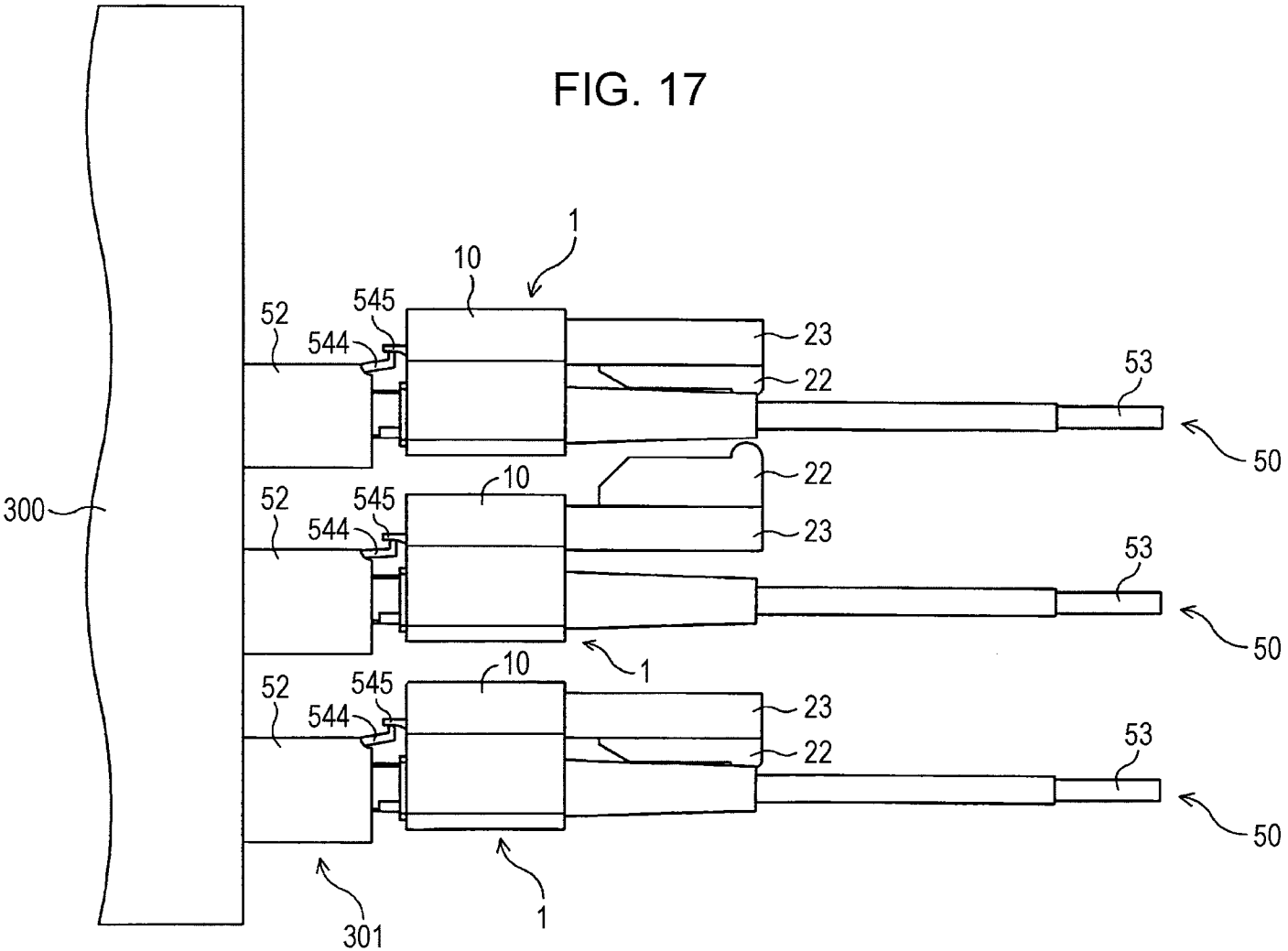
FIG. 17 is a view when viewed in the direction indicated by arrow XVII in FIG. 16B.
Figure 18:
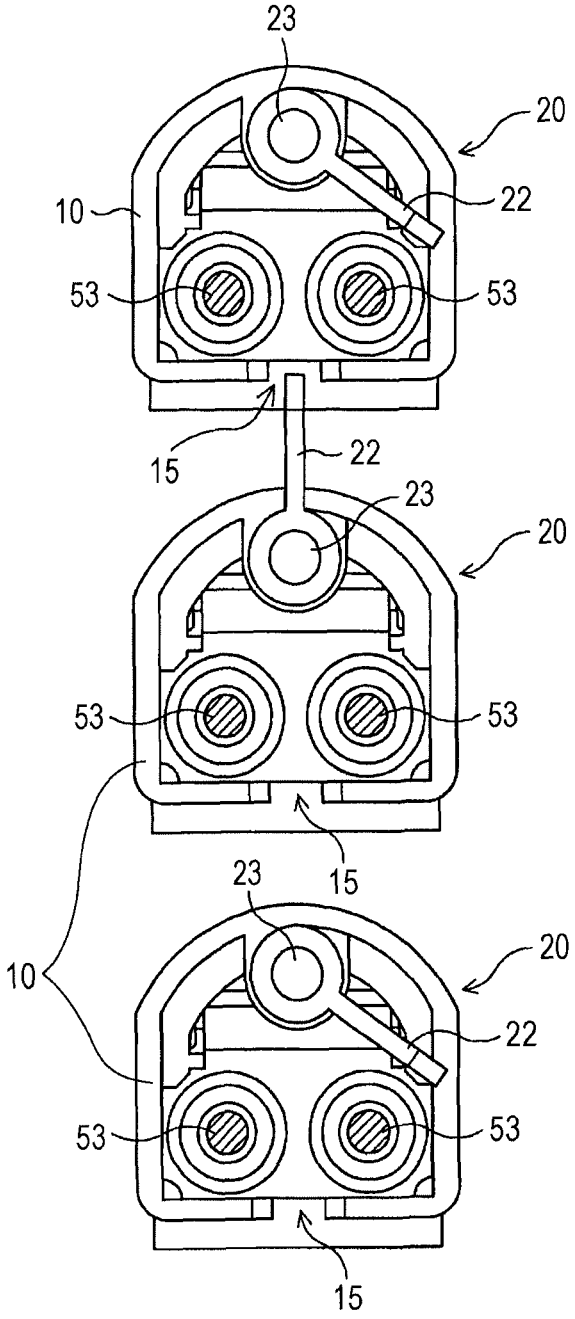
FIG. 18 is a view when viewed in the direction indicated by arrow XVIII in FIG. 16B.

FIG. 15 is a perspective view illustrating an example of an FC switch 300 serving as an information processing apparatus. In this example, three female connectors 52 are vertically arranged (i.e., the female connectors 52 are vertically arranged at three stages) at each input/output port 301. FIGS. 16A and 16B are enlarged views of one input/output port 301 of the FC switch in FIG. 15. In the state illustrated in FIG. 16A, all of the adapter-equipped communication cable units 50 are locked, and in the state illustrated in FIG. 16B, the locked states of some of the adapter-equipped communication cable units 50 are released. FIG. 17 is a view when viewed in the direction indicated by arrow XVII in FIG. 16B and FIG. 18 is a view when viewed in the direction indicated by arrow XVIII in FIG. 16B. FIGS. 17 and 18 illustrate only three vertically arranged adapter-equipped communication cable units 50 and do not illustrate the other adapter-equipped communication cable units 50.

According to the lock-release adapter 1, even when three or more female connectors 52 are vertically arranged (even when the female connectors 52 are vertically arranged at three stages or more) at the input/output port 301 and the upper and lower gaps of the female connector 52 located at the middle are significantly small as illustrated in FIGS. 15, 16A, 16B, 17, and 18, the locking may be easily released.

That is, since the knob 22 for performing an operation for releasing the locked state is formed so as to protrude from the shaft 23 of the lock release lever 20 extending along the FC cables 53, the knob 22 is located away from the male connector 54. This arrangement facilitates access of the operator's fingers to the knob 22, thereby improving workability.

(B) Second Embodiment

Figure 19:
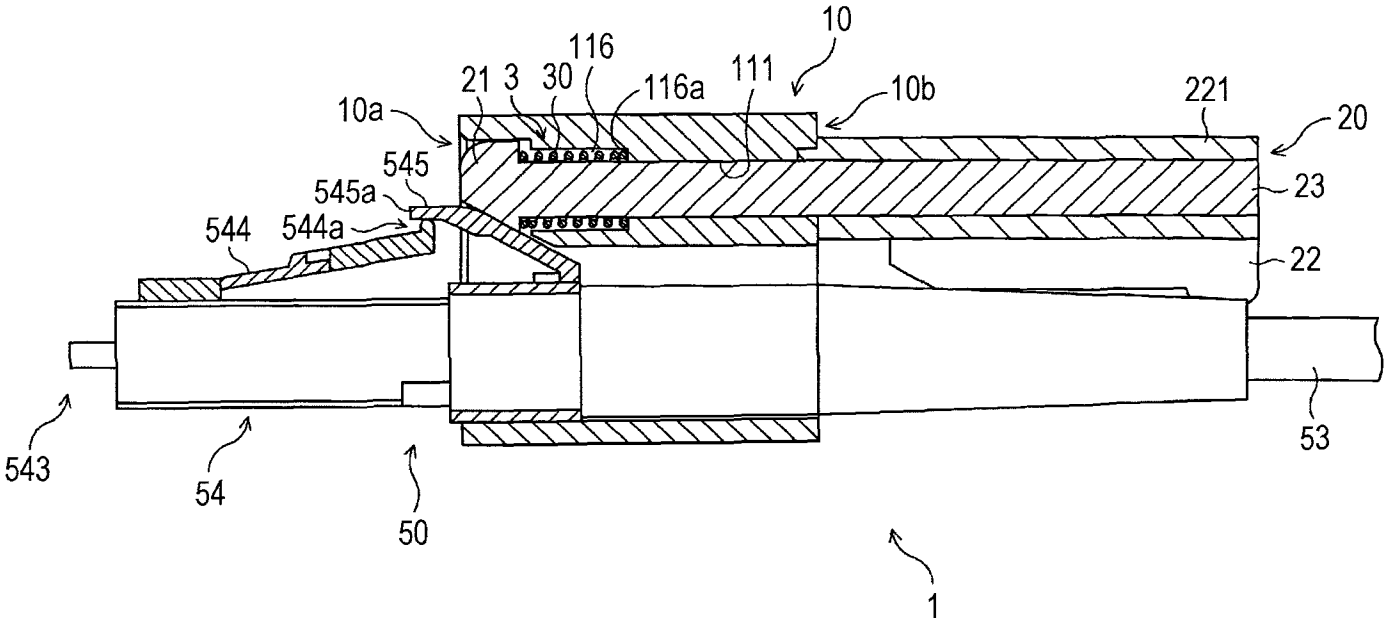
FIG. 19 is a sectional side view illustrating a locked state of a lock-release adapter that is one example of a second embodiment.

FIG. 19 is a sectional side view illustrating the locked state of a lock-release adapter 1 that is one example of the second embodiment. In FIG. 19, the internal configurations of elements other than the lock projections 544 and the lock-release aid plate 545 of the male connector 54 and the internal configuration of the FC cables 53 are omitted for convenience of illustration.

As in the lock-release adapter 1 according to the first embodiment, the lock-release adapter 1 that is one example of the second embodiment is attached to a male connector 54 of a communication cable unit 50 as illustrated in FIG. 28, to facilitate the locked-state releasing work using the lock projections 544.

In FIG. 19, reference numerals that are the same as or substantially the same as those used hereinabove denote the same or substantially the same portions, and thus detailed descriptions thereof are not given hereinafter.

The lock-release adapter 1 that is one example of the second embodiment has an adapter housing 10 and a lock release lever 20, as in the first embodiment.

Figure 20A:
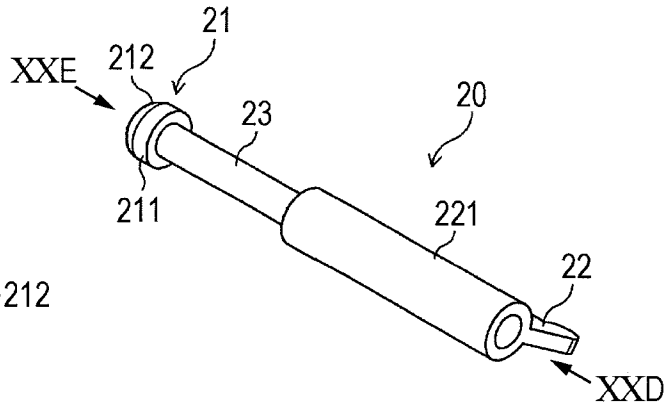
FIGS. 20A to 20E illustrate the configuration of a lock release lever of the lock-release adapter that is one example of the second embodiment.
Figure 20B:
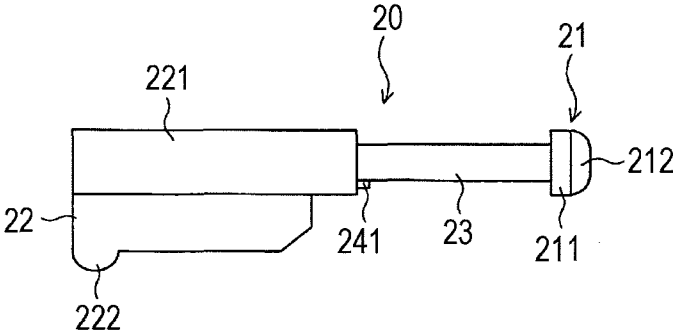
Figure 20E:
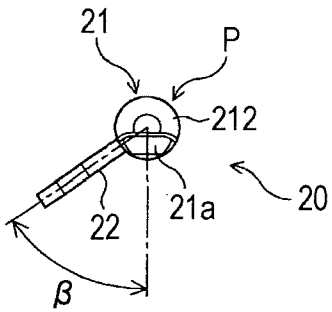
Figure 20C:
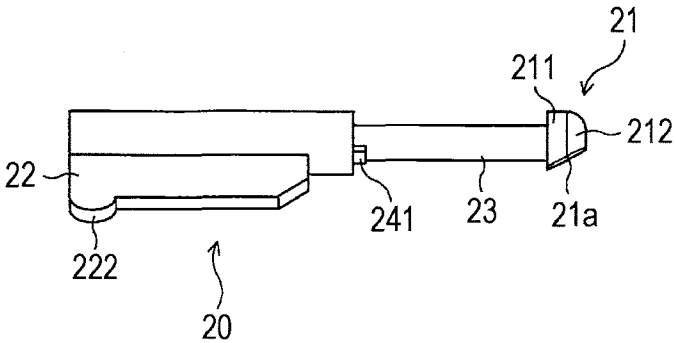
Figure 20D:
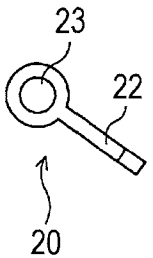

FIGS. 20A to 20E illustrate the configuration of the lock release lever 20 of the lock-release adapter 1 that is one example of the second embodiment. More specifically, FIG. 20A is a perspective view of the lock release lever 20, FIG. 20B is a top view thereof, FIG. 20C is a front view thereof, and FIGS. 20D and 20E are side views thereof. FIG. 20D is a view when viewed in the direction indicated by arrow XXD in FIG. 20A and FIG. 20E is a view when viewed in the direction indicated by arrow XXE in FIG. 20A.

Figures 21A, 21B, 21C, 21D, 21E:
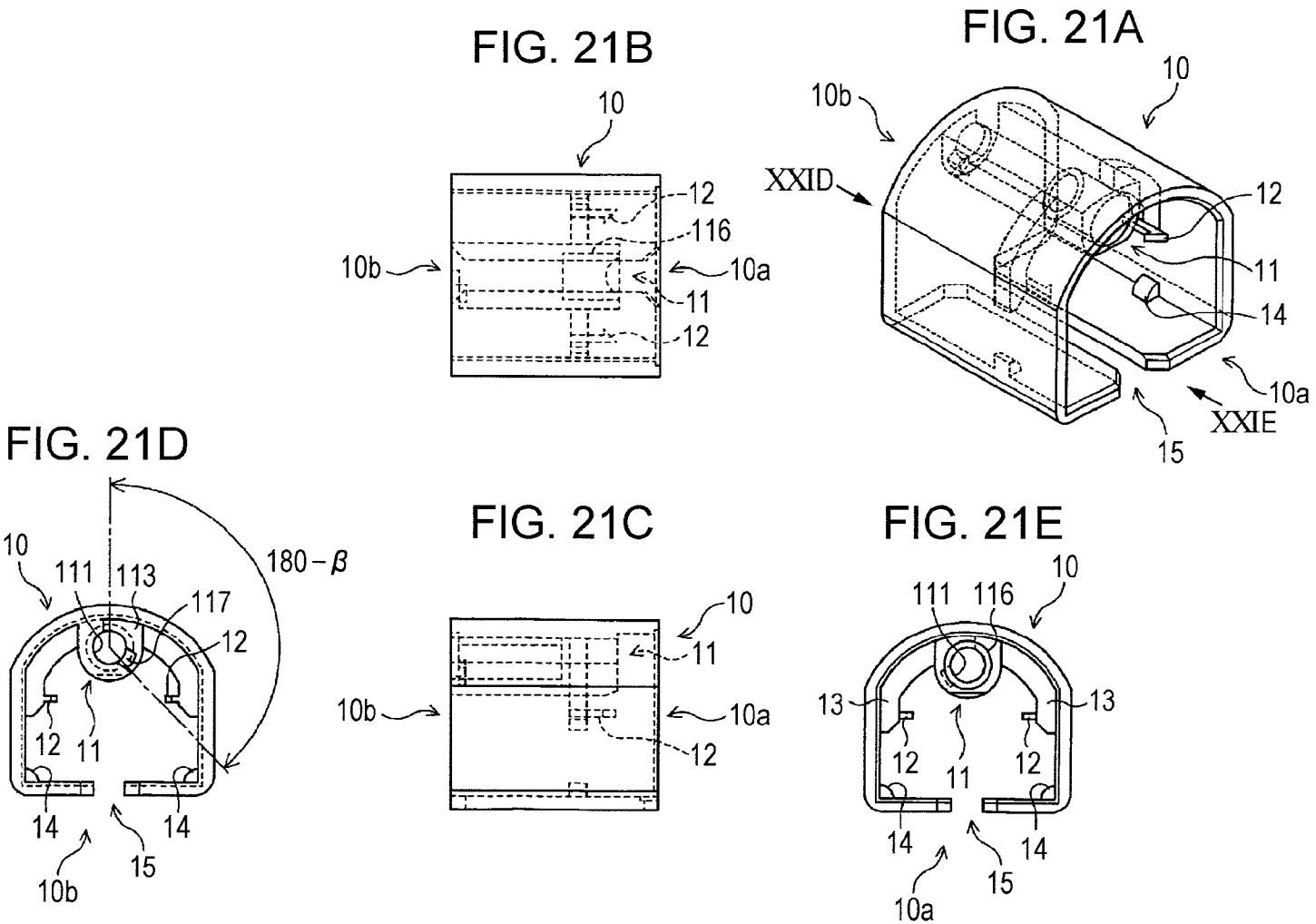
FIGS. 21A to 21E illustrate the configuration of an adapter housing of the lock-release adapter that is one example of the second embodiment.

FIGS. 21A to 21E illustrate the configuration of the adapter housing 10 of the lock-release adapter 1 that is one example of the second embodiment. More specifically, FIG. 21A is a perspective view of the adapter housing 10, FIG. 21B is a top view thereof, FIG. 21C is a front view thereof, and FIGS. 21D and 21E are side views thereof. FIG. 21D is a view when viewed in the direction indicated by arrow XXID in FIG. 21A and FIG. 21E is a view when viewed in the direction indicated by arrow XXIE in FIG. 21A.

Figure 22A:
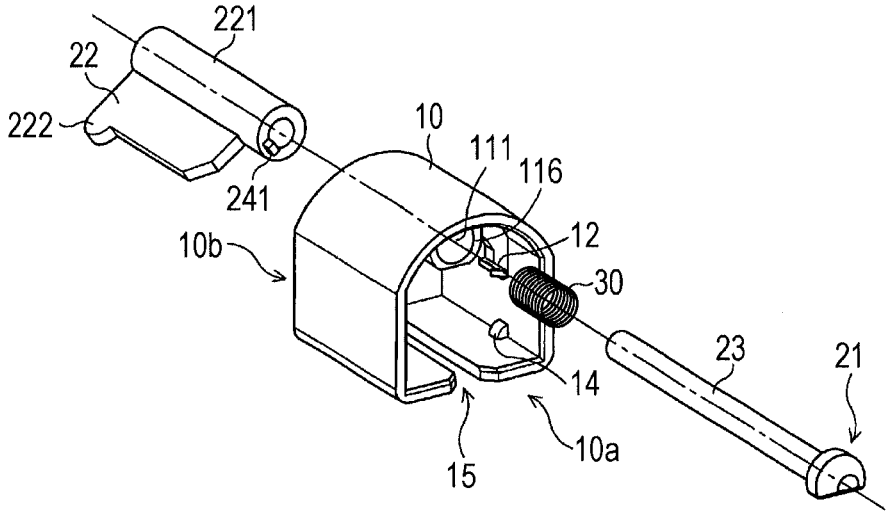
FIGS. 22A and 22B are exploded perspective views illustrating the configuration of the lock-release adapter that is one example of the second embodiment.
Figure 22B:
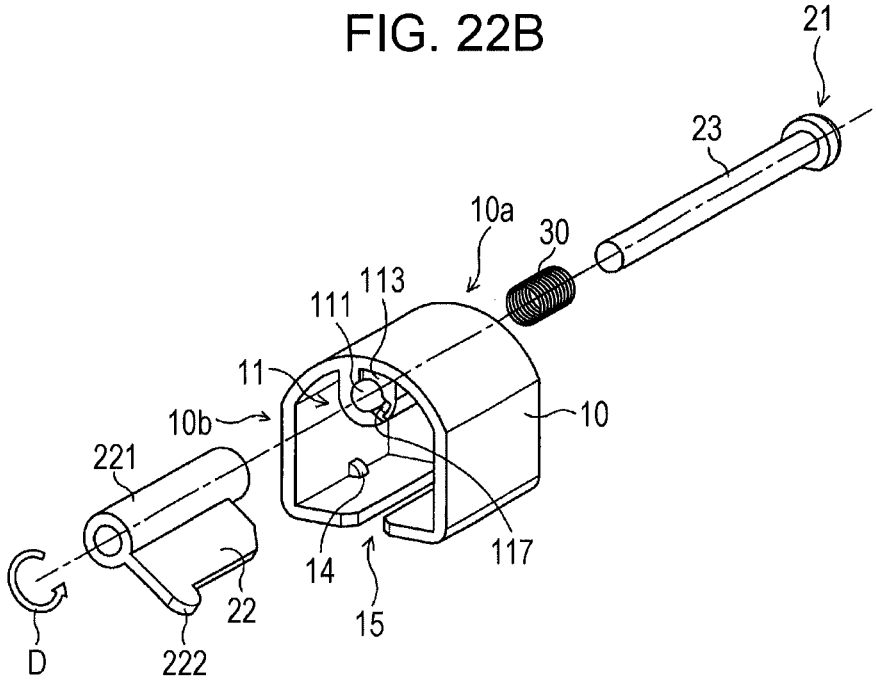

FIGS. 22A and 22B are exploded perspective views illustrating the configuration of the lock-release adapter 1 that is one example of the second embodiment. FIG. 22A is a view when viewed from an opening 10*a* of the adapter housing 10 and FIG. 22B is a view when viewed from an opening 10*b* thereof.

In the second embodiment, the lock release lever 20 has a head 21 at one end of a cylindrical shaft 23 and has a pipe member 221 at another end of the shaft 23, as illustrated in FIGS. 20A, 20B, and 20C. A knob 22 is formed at the pipe member 221.

In the second embodiment, the shape and the function of the head 21 are similar to those in the first embodiment, and descriptions thereof are not given hereinafter.

In the second embodiment, the position at which an oblique surface 21*a* of the head 21 of the lock release lever 20 and the position at which the knob 22 of the lock release lever 20 protrudes have a positional relationship as in the first embodiment.

The pipe member 221 is a tube-shaped member in which the shaft 23 is fitted. The knob 22, which is a plate member, protrudes from the circumferential surface of the pipe member 221 along the axial direction of the shaft 23. The shaft 23 is secured to the pipe member 221, for example, by press-fit or adhesion. In order to ensure the strength of the lock release lever 20, for example, a contact surface of at least one of the shaft 23 and the pipe member 221 may be knurled or may be provided with an anti-pivot groove.

A regulating projection (a pivot-regulating projection) 241 is formed at an end surface of the pipe member 221 at the head 21 side. The regulating projection 241 engages in a pivot lock recess (a pivot regulating recess) 117, formed in the adapter housing 10 as illustrated in FIG. 22B, to regulate (inhibit) pivot of the lock release lever 20. That is, the regulating projection 241 and the pivot lock recess 117 serve as a pivot inhibitor that inhibits the opening angle of the lock release lever 20.

The pivot lock recess 117 is formed by cutting off a lower end portion of the pivot-angle regulating ditch 113 at the surface of the guide 11 at the opening 10*b* side such that the pivot lock recess 117 has a size into which the regulating projection 24 may be inserted, as illustrated in FIG. 21D. That is, in the example illustrated in FIG. 21D, the pivot lock recess 117 is formed at a position around the opening of the arm-portion through hole 111 of the guide 11 at about 135 degrees clockwise from the upper side of the arm-portion through hole 111. Thus, the pivot lock recess 117 is adjacent to the pivot-angle regulating ditch 113.

The regulating projection 241 engages in the pivot lock recess 117 to regulate the pivot of the lock release lever 20. That is, the regulating projection 241 and the pivot lock recess 117 cooperate with each other to serve as a latch, thereby realizing the pivot regulating mechanism for the lock release lever 20.

For releasing the function (realized by the regulating projection 241) of the pivot regulating mechanism for the lock release lever 20, the lock release lever 20 is pulled toward the opposite side of the female connector 52 (i.e., toward the right side in FIG. 19) along the axis of the shaft 23 to release the engagement of the regulating projection 241 and the pivot lock recess 117. In addition, the lock release lever 20 is pivoted in the direction indicated by arrow D in FIG. 22B so as to move the regulating projection 241, pulled out of the pivot lock recess 117, to the pivot-angle regulating ditch 113 provided adjacent to the pivot lock recess 117.

Similarly to the pivot-angle regulating projection 24 in the first embodiment, the regulating projection 241 moves in the pivot-angle regulating ditch 113 in accordance with the pivot of the lock release lever 20. That is, the regulating projection 241 also has the function of the pivot-angle regulating projection 24 described above.

In addition, the lock-release adapter 1 that is one example of the second embodiment has a biasing member 3 for biasing the regulating projection 241 to the pivot lock recess 117 when the lock release lever 20 assumes the first posture as illustrated in FIG. 19.

As illustrated in FIG. 19, the biasing member 3 has a spring attachment hole 116 and a spring (an elastic member) 30, which is disposed in the spring attachment hole 116. The biasing member 3 biases the lock release lever 20 to the female connector 52 (i.e., to the right side in FIG. 19).

The spring attachment hole 116 is formed at the opening 10*a* side of the arm-portion through hole 111 in the adapter housing 10 by concentrically increasing the inner diameter of the arm-portion through hole 111 to a given depth. The spring 30 is disposed in the spring attachment hole 116 so as to surround the shaft 23 of the lock release lever 20. The axial length of the shaft 23 for the spring 30 is larger than the depth of the spring attachment hole 116. The spring 30 is disposed in the spring attachment hole 116 while the spring 30 is compressed by the head 21 of the lock release lever 20 and a bottom portion 116*a* of the spring attachment hole 116.

With this arrangement, when the lock release lever 20 assumes the first posture as illustrated in FIG. 19, the biasing member 3 biases the lock release lever 20 to the female connector 52 side so as to press the regulating projection 241 to the pivot lock recess 117.

That is, in the lock-release adapter 1 according to the second embodiment, with the regulating projection 241 engaging in the pivot lock recess 117 in the adapter housing 10, the biasing member 3 biases the lock release lever 20 so as to maintain the engaged state. As a result, the pivot of the lock release lever 20, the pivot being not intended by the operator, may be inhibited and an unintended release of the locked state is inhibited. Thus, the reliability may be improved.

The spring 30 in the biasing member 3 may be implemented by another elastic member, such as a rubber member, as appropriate.

The lock release lever 20 is attached to the adapter housing 10 configured described above to thereby assemble the lock-release adapter 1 that is one example of the second embodiment.

More specifically, first, the spring 30 is inserted from the opening 10*a* of the adapter housing 10 into the spring attachment hole 116, as illustrated in FIG. 22A. Thereafter, the shaft 23 of the lock release lever 20 is inserted from the opening 10*a* into the spring 30 and the arm-portion through hole 111 of the guide 11.

As illustrated in FIG. 22B, the pipe member 221 is inserted from the opening 10*b* of the adapter housing 10 and is coupled with the end portion opposite to the head 21 of the shaft 23 protruding from the guide 11, and the pipe member 221 and the shaft 23 are secured by press-fit or adhesion.

In this case, the lock release lever 20 is adjusted so that the position at which the oblique surface 21*a* is formed and the position from which the knob 22 protrudes has the above-described given positional relationship.

The lock-release adapter 1 is configured as described above.

The communication cable unit 50 is attached to the lock-release adapter 1 that is one example of the second embodiment by a method that is similar to the method in the first embodiment.

The adapter-equipped communication cable unit 50, i.e., the communication cable unit equipped with the lock-release adapter 1 that is one example of the second embodiment, is also attached to the female connector 52 of the input/output port 301 of the FC switch 300 serving as an information processing apparatus, as in the first embodiment illustrated in FIGS. 12 and 13 and so on.

Figure 23:
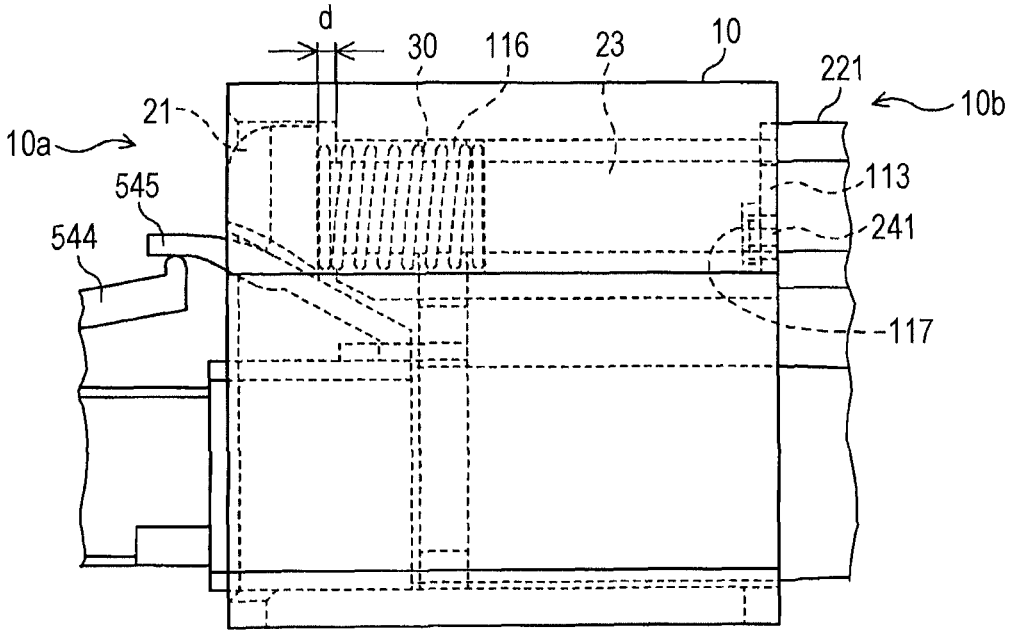
FIG. 23 is a sectional side view illustrating a pivot operation of a lock release lever of a lock-release adapter that is one example of the second embodiment.
Figure 24:
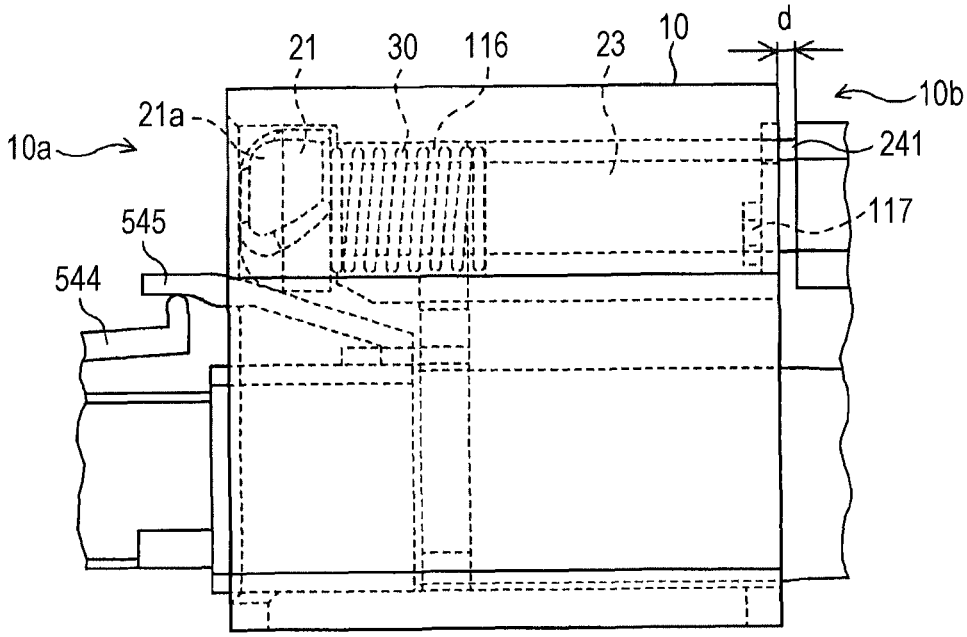
FIG. 24 is a sectional side view illustrating a pivot operation of the lock release lever of the lock-release adapter that is one example of the second embodiment.
Figure 25:
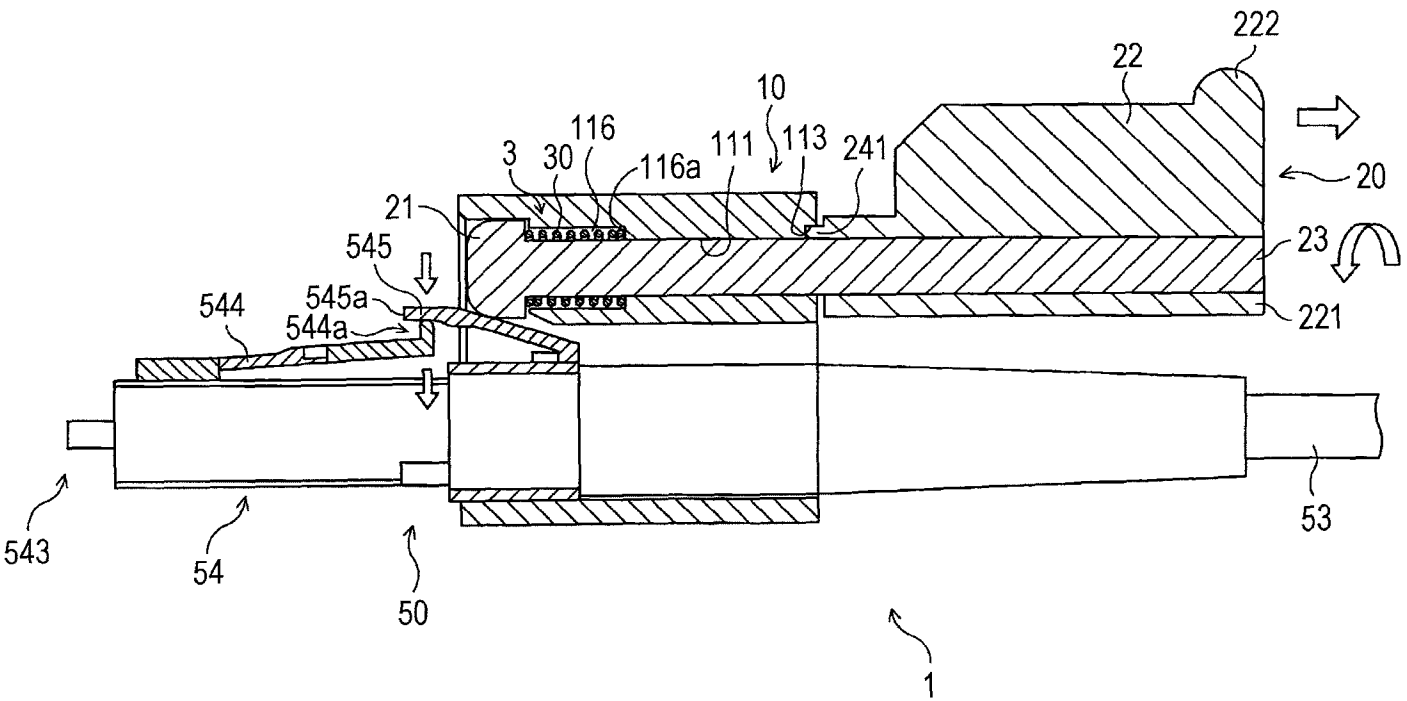
FIG. 25 is a sectional side view illustrating the unlocked state of the lock-release adapter that is one example of the second embodiment.
Figure 26:
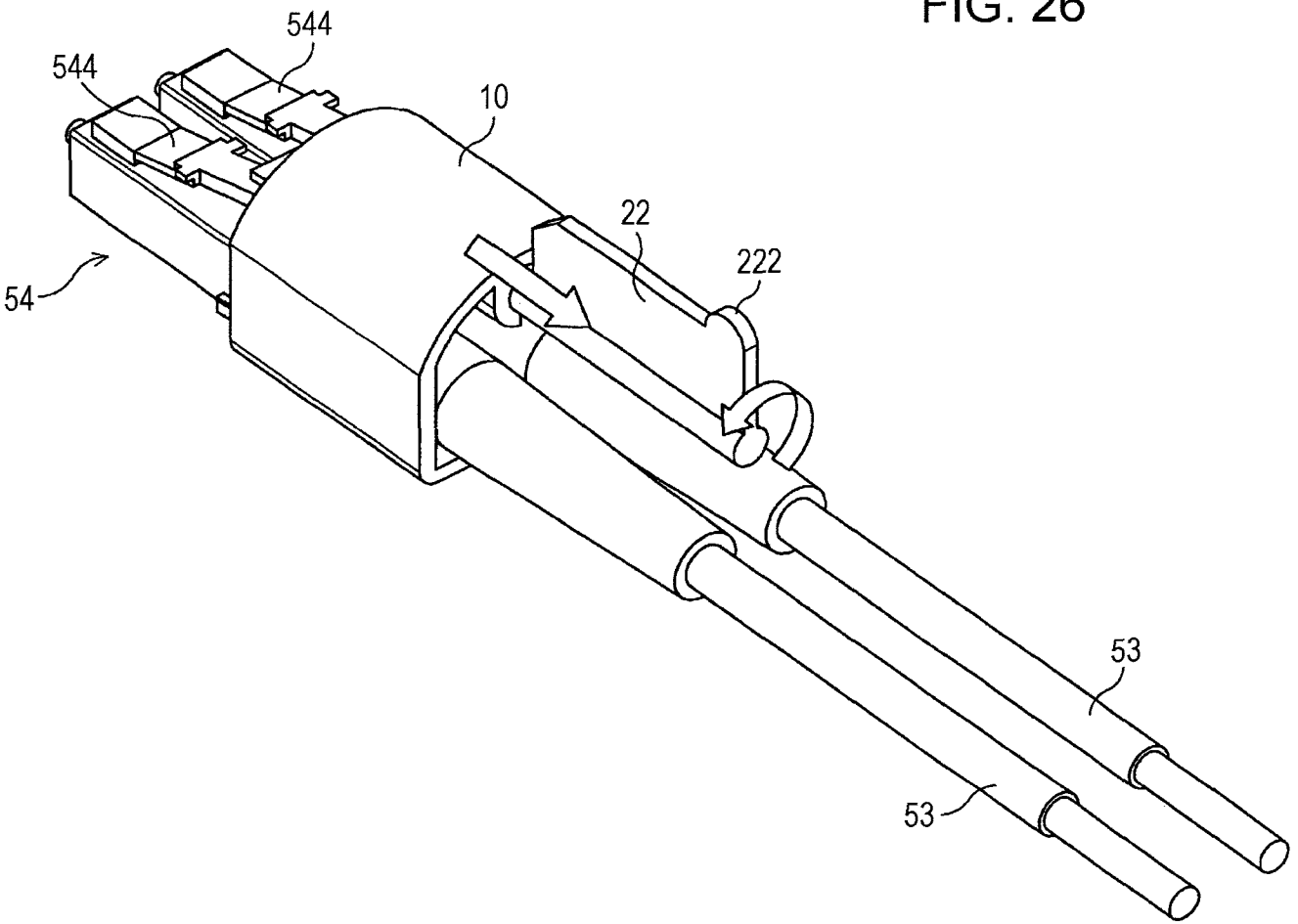
FIG. 26 is a perspective view illustrating the lock-release adapter that is one example of the second embodiment.
Figure 27:
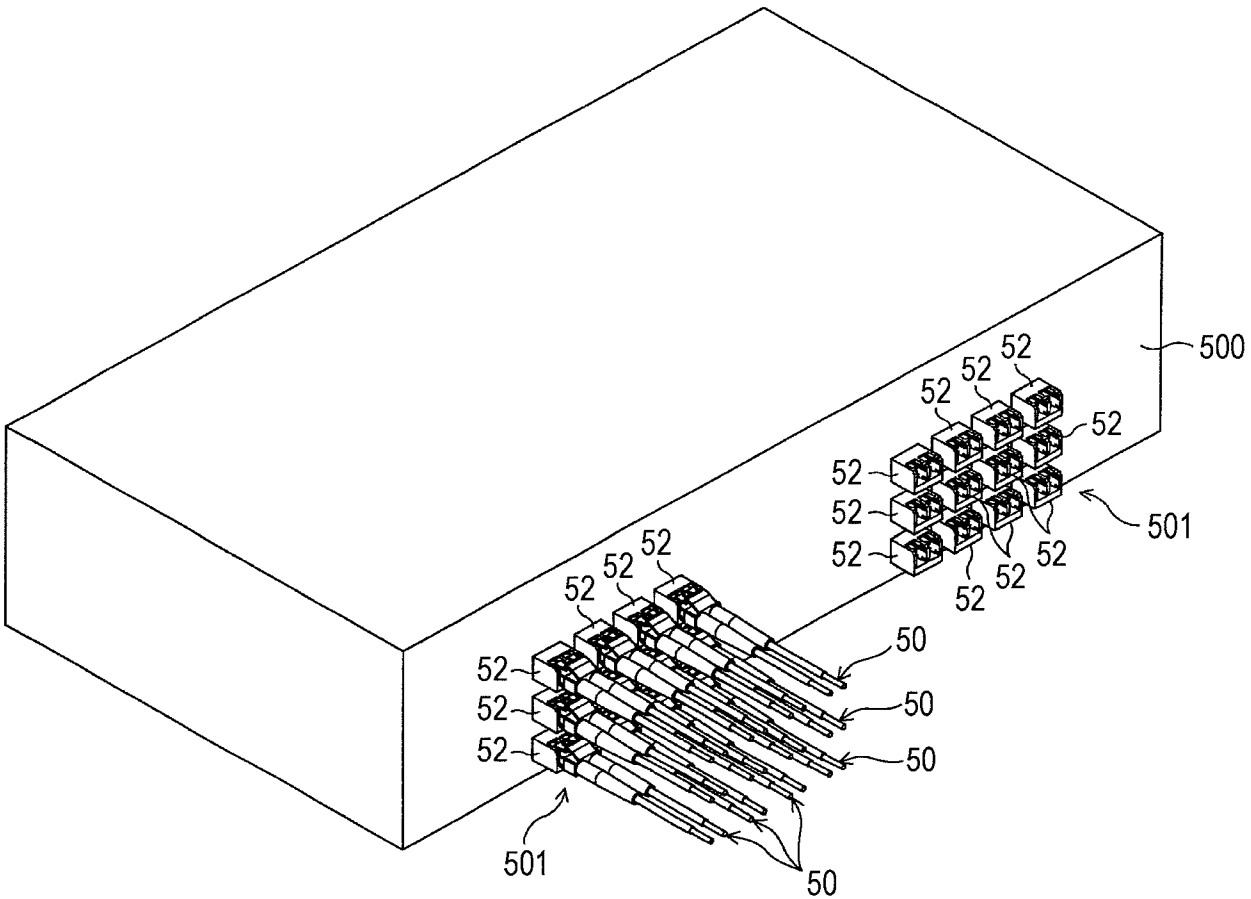
FIG. 27 RELATED ART
FIG. 27 is a perspective view of an information processing apparatus.

FIGS. 23 and 24 are side perspective views illustrating a pivot operation of the lock release lever 20 in the lock-release adapter 1 that is one example of the second embodiment. FIG. 23 illustrates a locked state of the lock-release adapter 1 and FIG. 24 illustrates an unlocked state thereof. FIG. 25 is a sectional side view illustrating an unlocked state of the lock-release adapter 1 that is one example of the second embodiment and FIG. 26 is a perspective view thereof. In FIG. 25, the internal configurations of elements other than the lock projections 544 and the lock-release aid plate 545 of the male connector 54 and the internal configuration of the FC cables 53 are omitted for convenience of illustration.

In the locked state illustrated in the example of FIG. 23, the head 21 is guided by the oblique surface 21*a* so as to face the lock-release aid plate 545, so that the lock-release aid plate 545 and the lock projections 544 are not depressed.

In this state, the regulating projection 241 of the lock release lever 20 engages in the pivot lock recess 117 in the adapter housing 10 to thereby inhibit the pivot of the lock release lever 20.

The lock release lever 20 is pressed against the adapter housing 10 (i.e., toward the left side in FIG. 23) by the elasticity of the spring 30, so that the engagement of the pivot-angle regulating projection 24 and the pivot lock recess 117 is maintained.

For releasing the locked state as illustrated in FIG. 23, the operator pulls the lock release lever 20 in a direction opposite to the head 21 (i.e., to the right side in FIG. 24, or in the lock-release-lever pulling direction) to pull out the regulating projection 241 from the pivot lock recess 117, thereby releasing the engagement, as illustrated in FIG. 24. During the operation, it is possible to easily and reliably pull the lock release lever 20 by hooking his or her finger on the projection portion 222 of the knob 22. Thus, the operability improves.

Releasing the engagement of the pivot lock recess 117 and the regulating projection 241 allows the regulating projection 241 to move in the pivot-angle regulating ditch 113. In such a state, the lock release lever 20 may be pivoted in a range in which the regulating projection 241 is located in the pivot-angle regulating ditch 113.

In the example illustrated in FIG. 23, the gap d between the end surface of the head 21 at the shaft 23 side and the end surface of the guide 11 at the opening 10*a* side corresponds to a lever stroke d (see FIG. 24) of the lock release lever 20.

In the lock-release adapter 1 according to the second embodiment, the operator pulls the lock release lever 20 in the lock-release lever pulling direction to release the engagement of the regulating projection 241 and the pivot lock recess 117, as described above, and pivots the lock release lever 20 in the engagement-released state. As a result, the head 21 is pivoted while the pivot-angle regulating projection 241 is guided into the pivot-angle regulating ditch 113.

Similarly to the first embodiment, even when the lock release lever 20 in the lock-release adapter 1 according to the second embodiment is pivoted in the arm-portion through hole 111, the regulating projection 241 once disposed in the pivot-angle regulating ditch 113 abuts the lower end portion of the pivot angle regulating ditch 113 and thus does not easily fall out of the pivot-angle regulating ditch 113.

As a result of the pivot of the head 21, the cylindrical portion 211 or the dome portion 212 of the head 21 depresses the lock-release aid plate 545 of the male connector 54, so that the lock-release aid plate 545 depresses the lock projections 544 to thereby release the locked state of the female connector 52 and the male connector 54.

As illustrated in FIGS. 25 and 26, when the knob 22 is directed upward to assume the second posture, the cylindrical portion 211 of the head 21 depresses the lock projections 544 of the male connector 54 to release the locked state.

According to lock-release adapter 1 that is one example of the second embodiment, advantages that are similar to those in the first embodiment may be obtained. In addition, since the regulating projection 241 and the pivot lock recess 117 inhibit an unintended release of the locked state, the reliability may be improved.

Additionally, with the regulating projection 241 engaging in the pivot lock recess 117 of the adapter housing 10, the biasing member 3 applies the bias so as to maintain the engagement, so that the engagement of the regulating projection 241 and the pivot lock recess 117 is maintained. Thus, the reliability may be further improved.

(C) Modifications

The present disclosure is not limited to the above-described embodiments, and various modifications may be made thereto without departing from the spirit and scope thereof.

Although FC cables configured as a DLC connector have been described as an example of the communication cable unit 50 in the above-described embodiments, the present disclosure is not limited thereto. For example, the present disclosure is applicable to connector units using various connectors and having similar push-pull locking functions.

Although the descriptions in the above embodiments have been given of examples in which the head 21 is formed to have a substantially spherical shape having the cylindrical portion 211 and the dome portion 212 and the oblique surface 21*a* is formed by cutting off a portion of the spherical shape, the present disclosure is not limited thereto. That is, another arrangement may also be employed as appropriate. For example, the arrangement may be such that the head 21 has the portion (the depression projection portion) that protrudes partially in a direction perpendicular to the axial direction of the shaft 23 and the portion that does not protrude and those portions are configured to be switchable according to the pivot of the lock release lever 20.

In the above-described embodiments, the position at which the oblique surface 21*a* is formed and the position from which the knob 22 protrudes have a given positional relationship, and the lock-release adapter 1 is configured so that the knob 22 protrudes to a lower power than the horizontal plane when the lock release lever 20 assumes the first posture, as illustrated in FIG. 5E. The present disclosure, however, is not limited to the illustrated configuration. That is, for example, when a sufficient space is available for installation, the position at which the oblique surface 21*a* is formed and the position from which the knob 22 protrudes may have a positional relationship other than the given relationship described above, for example, may be arranged parallel to each other.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A lock-release adapter attached to a first connector, the first connector being put into a locked state with a second connector upon the first connector being fitted with the second connector, the locked state being released when a lock-release projection of the first connector is depressed, the lock-release adapter comprising:

a holder fitted with the first connector; and an axial member pivotally supported by the holder, the axial member including, at one end in a direction of the pivot axis of the axial member, a projection portion that projects in a direction perpendicular to the pivot axis, the projection portion depressing the lock-release projection to release the locked state when the axial member is in a first pivot position, the projection portion of the axial member includes a cylindrical portion and a dome portion on the cylindrical portion, and the projection portion of the axial member has an oblique surface that is formed by cutting off a part of the cylindrical portion and dome portion.

2. The lock-release adapter according to claim 1, further comprising a pivot inhibitor that inhibits pivot of the axial member.

3. The lock-release adapter according to claim 2, wherein the pivot inhibitor comprises:

a pivot regulating projection that projects from an outer peripheral surface of the axial member; and a pivot regulating recess in which the pivot regulating projection engages, the pivot regulating recess being provided in an edge of a through hole that is provided in the holder to support the axial member.

4. The lock-release adapter according to claim 3, further comprising a biasing member that biases the pivot regulating projection to press the pivot regulating projection against the pivot regulating recess.

5. The lock-release adapter according to claim 1, wherein, the first connector is put into a locked state with the second connector when the lock-release projection of the first connector is engaged in an engagement hole of the second connector, and the lock-release projection of the first connector is depressed by the projection portion of the axial member to be removed from the engagement hole of the second connector so that the lock state is released when the axial member is in the first pivot position.

6. A communication cable unit comprising:

a first connector that includes a lock-release projection;

a second connector that is fitted with the first connector to be put into a locked state, and is released when the lock-release projection of the first connector is depressed; and a lock-release adapter including a holder fitted with the first connector, and an axial member pivotally supported by the holder, the axial member including, at one end in a direction of a pivot axis of the axial member, a projection portion that projects in a direction perpendicular to a pivot axis, the projection portion depressing the lock-release projection to release the locked state when the axial member is in a first pivot position, the projection portion of the axial member includes a cylindrical portion and a dome portion on the cylindrical portion, and the projection portion of the axial member has an oblique surface that is formed by cutting off a part of the cylindrical portion and dome portion.

7. The communication cable unit according to claim 6, further comprising a pivot inhibitor that inhibits pivot of the axial member.

8. The communication cable unit according to claim 7, wherein the pivot inhibitor comprises:

a pivot regulating projection that projects from an outer peripheral surface of the axial member; and a pivot regulating recess in which the pivot regulating projection engages, the pivot regulating recess being provided in an edge of a through hole that is provided in the holder to support the axial member.

9. The communication cable unit according to claim 8, further comprising a biasing member that biases the pivot regulating projection to press the pivot regulating projection against the pivot regulating recess.

* * * * *